US010773224B2

(12) United States Patent
Oba et al.

(10) Patent No.: US 10,773,224 B2
(45) Date of Patent: Sep. 15, 2020

(54) CONTINUOUS MIXING APPARATUS, SYSTEM, AND CONTINUOUS MIXING METHOD FOR POWDER/GRANULAR MATERIAL AND VISCOUS LIQUID

(71) Applicant: SINTOKOGIO, LTD., Nagoya-shi, Aichi (JP)

(72) Inventors: Takahumi Oba, Toyokawa (JP); Tatsuyuki Aoki, Toyokawa (JP); Mikio Yoshino, Toyokawa (JP); Taisuke Horie, Fukuoka (JP); Yukinori Aoki, Fukuoka (JP)

(73) Assignee: SINTOKOGIO, LTD., Nagoya-shi (JP)

( * ) Notice: Subject to any disclaimer, the term of this patent is extended or adjusted under 35 U.S.C. 154(b) by 221 days.

(21) Appl. No.: 15/756,278

(22) PCT Filed: Oct. 12, 2016

(86) PCT No.: PCT/JP2016/080188
§ 371 (c)(1),
(2) Date: Feb. 28, 2018

(87) PCT Pub. No.: WO2017/168799
PCT Pub. Date: Oct. 5, 2017

(65) Prior Publication Data

US 2018/0243701 A1 Aug. 30, 2018

(30) Foreign Application Priority Data

Mar. 28, 2016 (JP) ..... 2016-062939

(51) Int. Cl.
*B01F 7/00* (2006.01)
*B01F 11/00* (2006.01)
(Continued)

(52) U.S. Cl.
CPC ..... *B01F 7/04* (2013.01); *B01F 3/1221* (2013.01); *B01F 3/14* (2013.01); *B01F 7/001* (2013.01);
(Continued)

(58) Field of Classification Search
CPC .... B01F 7/04; B01F 7/00116; B01F 7/00158; B01F 7/00133; B01F 7/001;
(Continued)

(56) References Cited

U.S. PATENT DOCUMENTS 3,964,732 A * 6/1976 Hartley ..... B01F 7/00158 366/192
2010/0284237 A1* 11/2010 Takemoto ..... B01F 3/1221 366/85

FOREIGN PATENT DOCUMENTS

CN 203495131 U 3/2014
EP 2206549 A1 7/2010
(Continued)

OTHER PUBLICATIONS

Jan. 10, 2017 International Search Report issued in International Patent Application No. PCT/JP2016/080188.
(Continued)

*Primary Examiner* — Huy Tram Nguyen
(74) *Attorney, Agent, or Firm* — Oliff PLC

(57) ABSTRACT

A continuous mixing apparatus for a powder/granular material and a viscous liquid, with a mixing cylinder, a shaft member which is on a central axis of the mixing cylinder and rotates inside the mixing cylinder, and a plurality of mixing paddles disposed on a surface of the shaft member, wherein the mixing cylinder is with a powder/granular material feed port on one end portion, a mixed material discharge port on the other end portion, and a viscous liquid injection unit between the powder/granular material feed port and the
(Continued)

mixed material discharge port, and the plurality of mixing paddles are disposed on the shaft member so as to form a spiral around the central axis, the plurality of mixing paddles being, in at least a portion between the viscous liquid injection unit and the mixed material discharge port, attached to provide first rows having an attachment angle of 5° to 60°.

20 Claims, 10 Drawing Sheets

(51) Int. Cl.

| | |
|---|---|
| ***B01F 7/04*** | (2006.01) |
| ***B22C 5/04*** | (2006.01) |
| ***B01F 3/12*** | (2006.01) |
| ***B01F 3/14*** | (2006.01) |
| ***B01F 15/00*** | (2006.01) |

(52) U.S. Cl.
CPC ..... *B01F 7/0025* (2013.01); *B01F 7/00116* (2013.01); *B01F 7/00125* (2013.01); *B01F 7/00133* (2013.01); *B01F 7/00158* (2013.01); *B01F 7/00633* (2013.01); *B01F 11/0088* (2013.01); *B01F 11/0091* (2013.01); *B01F 15/00155* (2013.01); *B01F 15/00389* (2013.01); *B01F 15/00409* (2013.01); *B22C 5/04* (2013.01); *B22C 5/045* (2013.01); *B01F 2015/00642* (2013.01); *B01F 2215/0044* (2013.01); *B01F 2215/0049* (2013.01); *B01F 2215/0422* (2013.01); *B01F 2215/0477* (2013.01); *B01F 2215/0481* (2013.01)

(58) Field of Classification Search
CPC ..... B01F 15/00409; B01F 15/00389; B01F 15/00155; B01F 11/0091; B01F 11/0088; B01F 7/00633; B01F 7/0025; B01F 7/00125; B01F 3/14; B01F 3/1221; B01F 2015/00642; B01F 2215/0481; B01F 2215/0477; B01F 2215/0044; B01F 2215/0422; B01F 2215/0049; B22C 5/04; B22C 5/045; B22C 5/0422
USPC ..... 366/276
See application file for complete search history.

(56) References Cited

FOREIGN PATENT DOCUMENTS

| | | | |
|---|---|---|---|
| JP | H04-129544 | U | 11/1992 |
| JP | H07-100349 | A | 4/1995 |
| JP | H09-313910 | A | 12/1997 |
| JP | 2002-263461 | A | 9/2002 |
| JP | 2003-010664 | A | 1/2003 |
| JP | 2013-071429 | A | 4/2013 |
| JP | 2013-237012 | A | 11/2013 |
| WO | 2015/188274 | A1 | 12/2015 |

OTHER PUBLICATIONS

Mar. 4, 2019 Extended European Search Report issued in European Patent Application No. 16897016.8.

* cited by examiner

[FIG. 1]
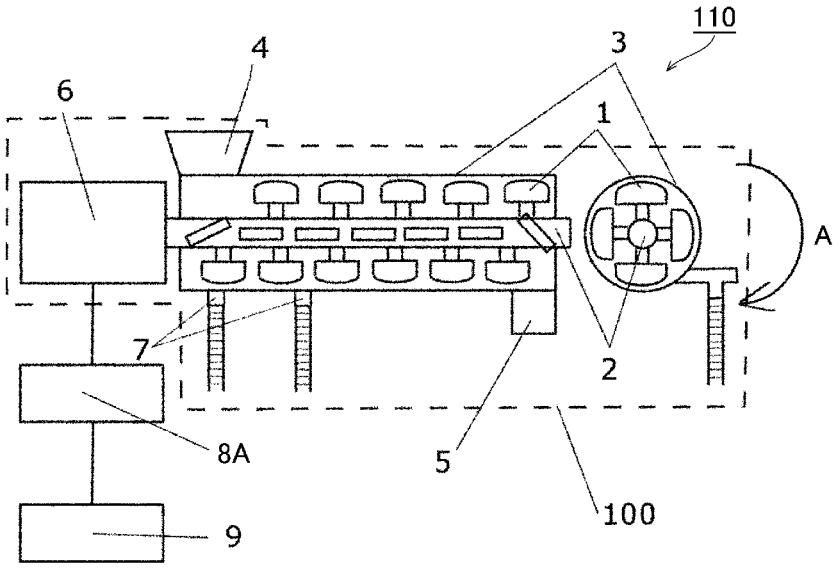
[FIG. 2]
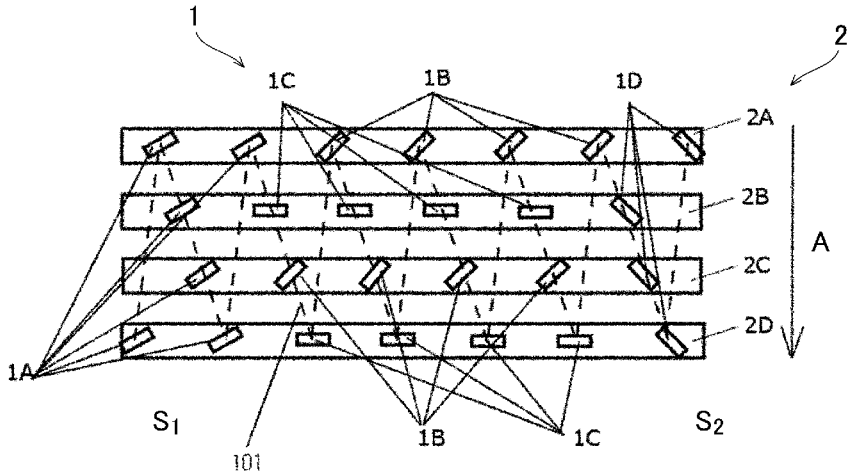

[FIG. 3]
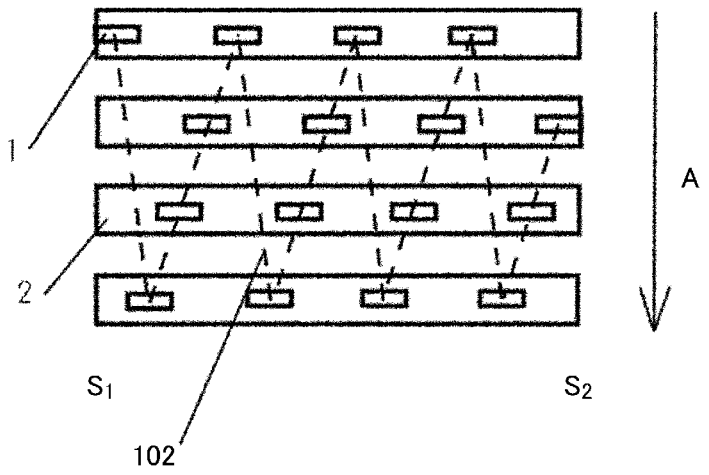
[FIG. 4]
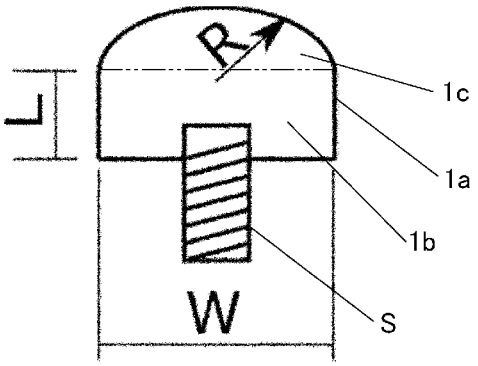

[FIG. 5]
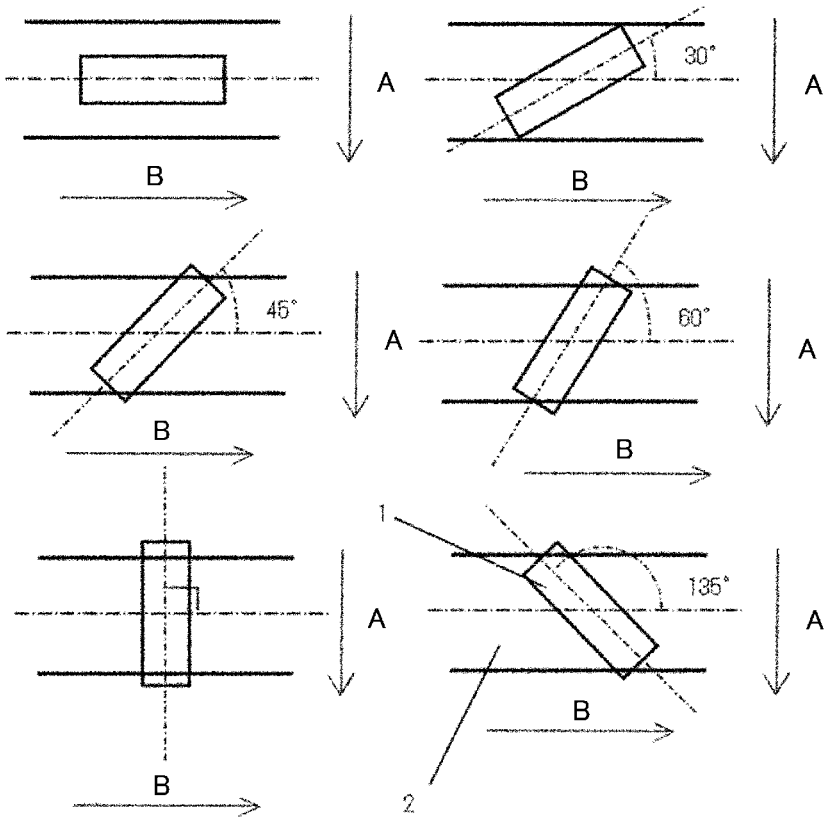
[FIG. 6]
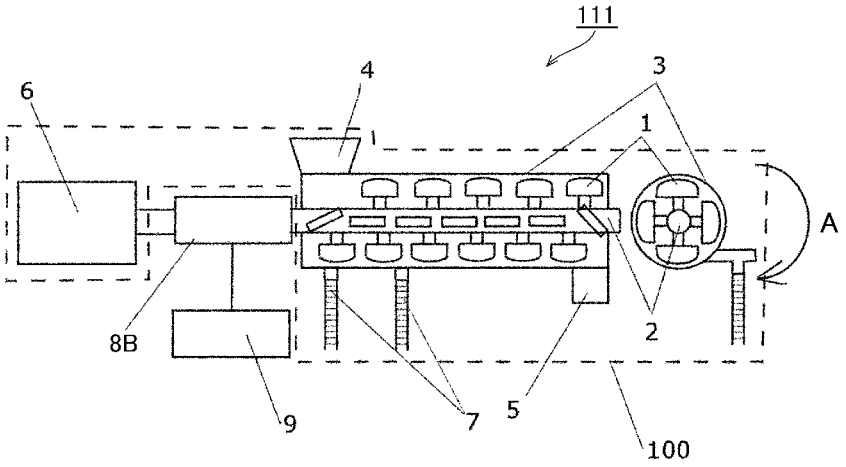

[FIG. 7]
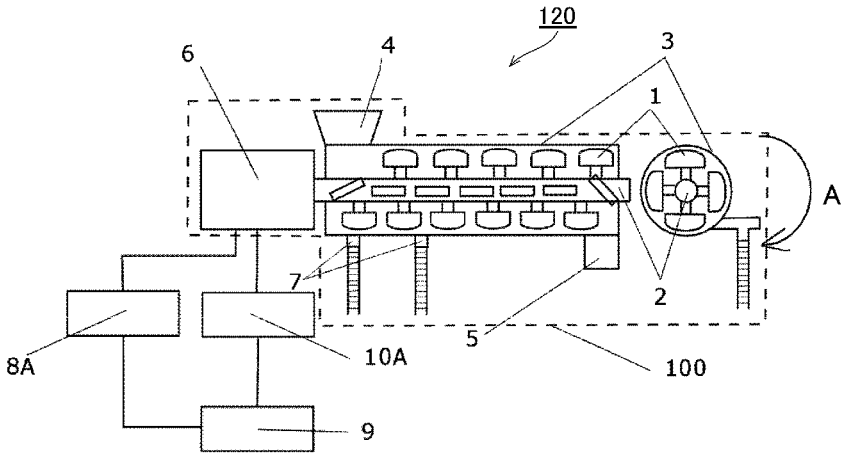
[FIG. 8]
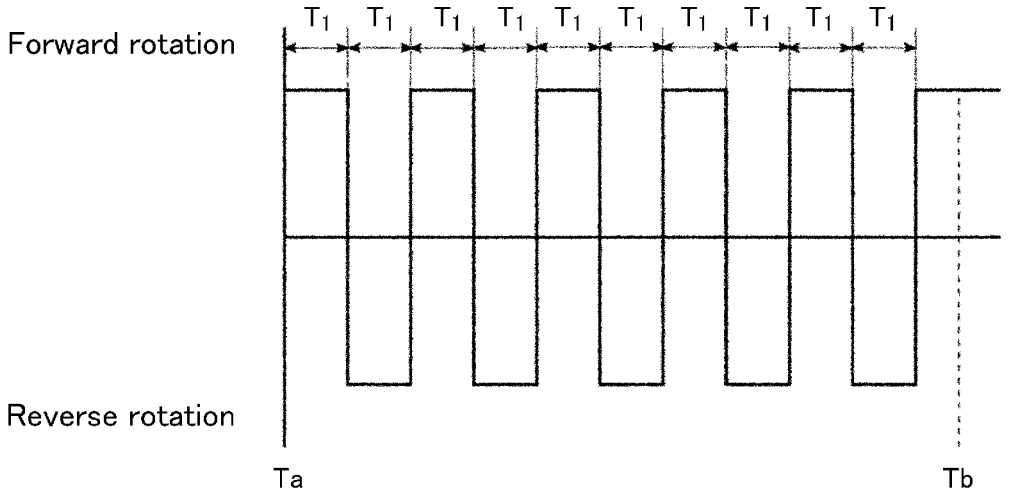

[FIG. 9]
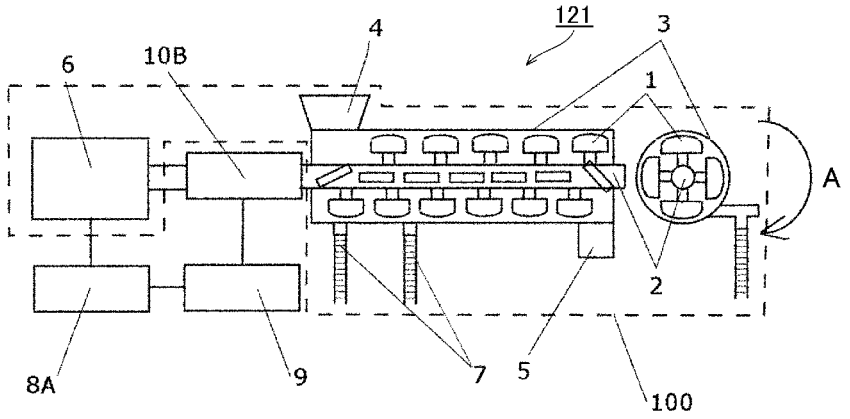
[FIG. 10]
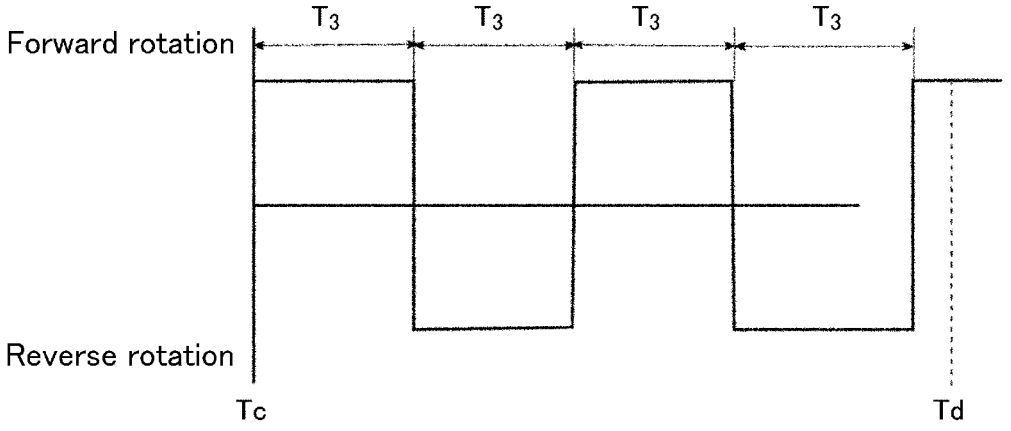

[FIG. 11]
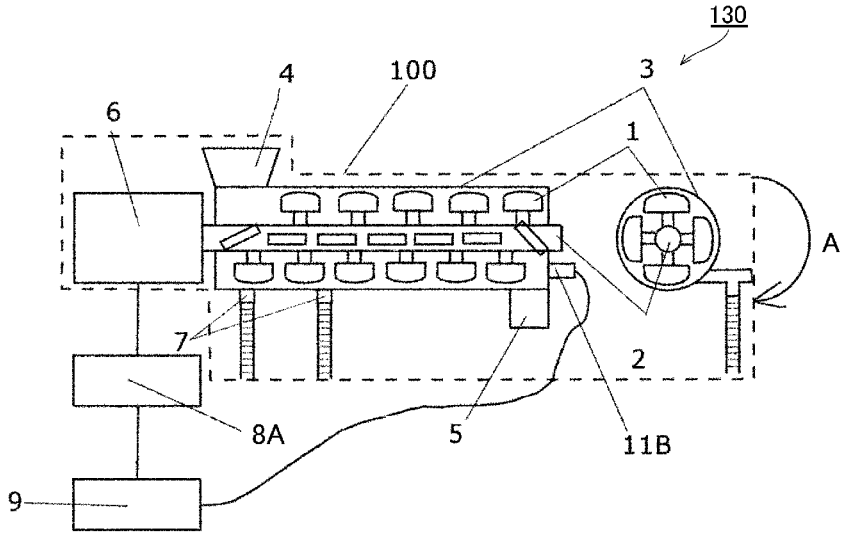
[FIG. 12]
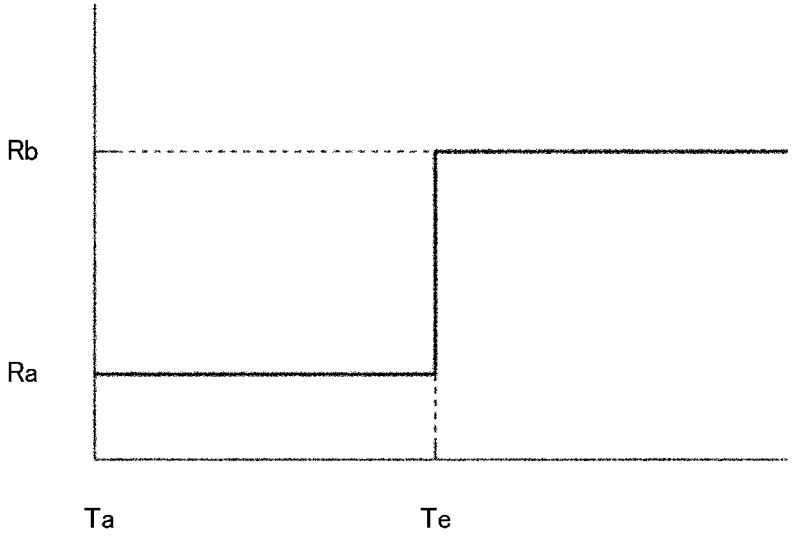

[FIG. 13]
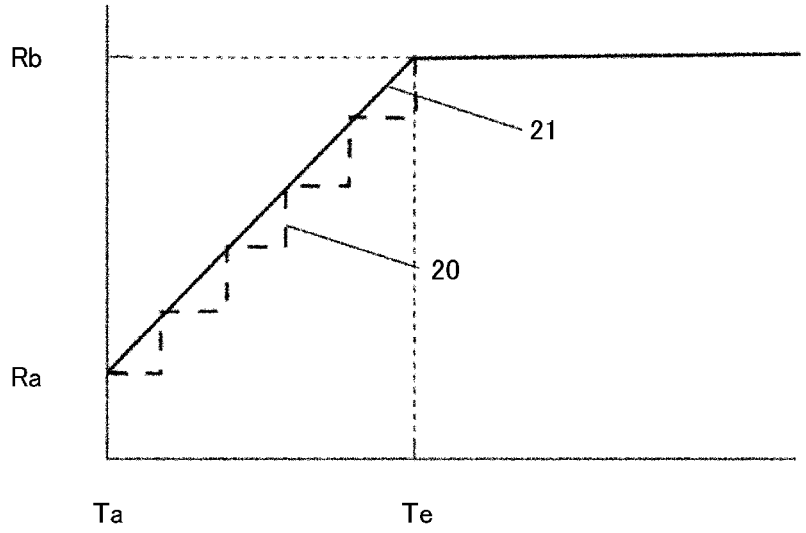
[FIG. 14]
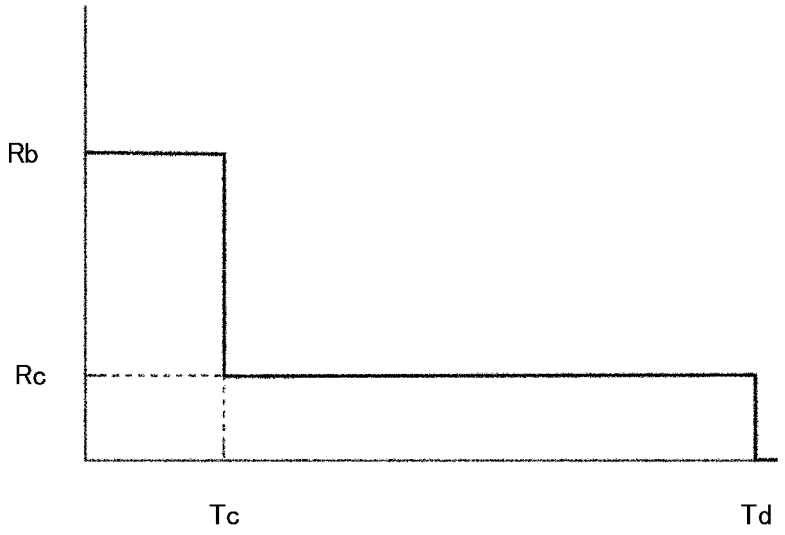

[FIG. 15]
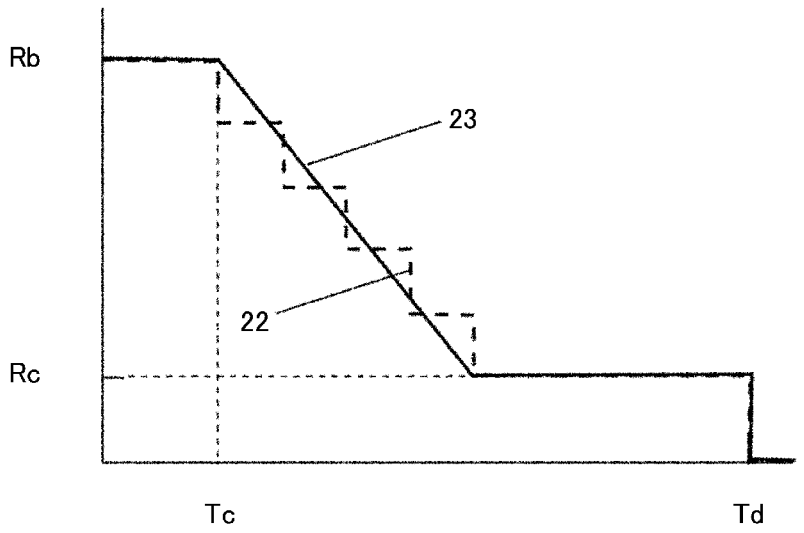
[FIG. 16]
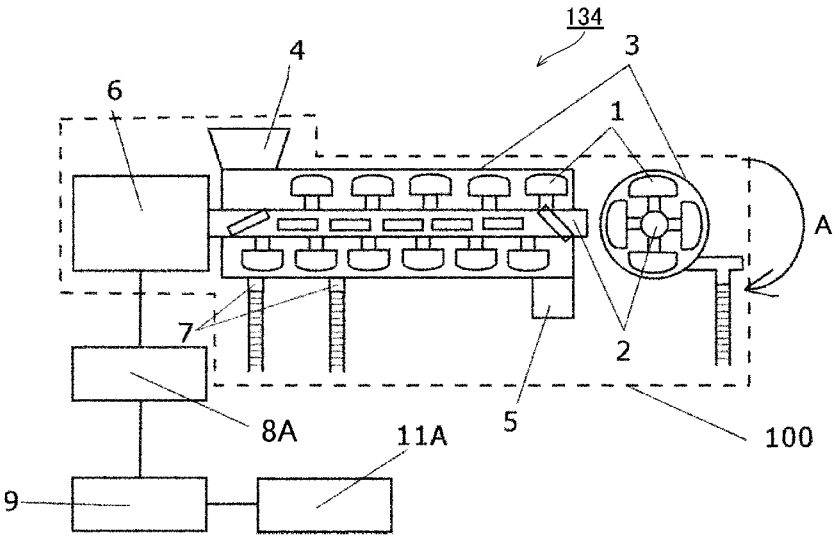

[FIG. 17]
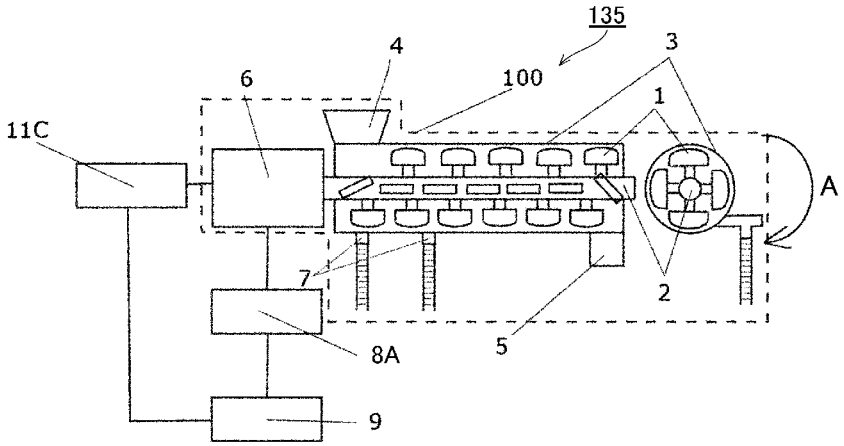
[FIG. 18]
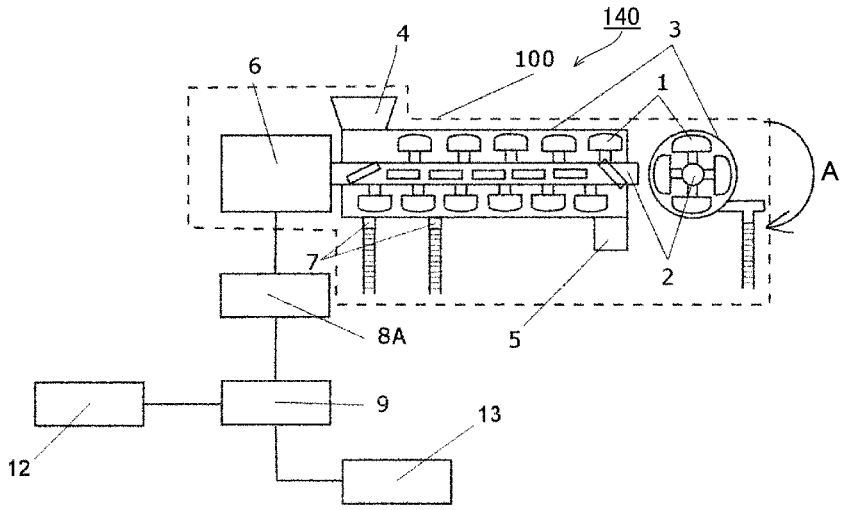

[FIG. 19]
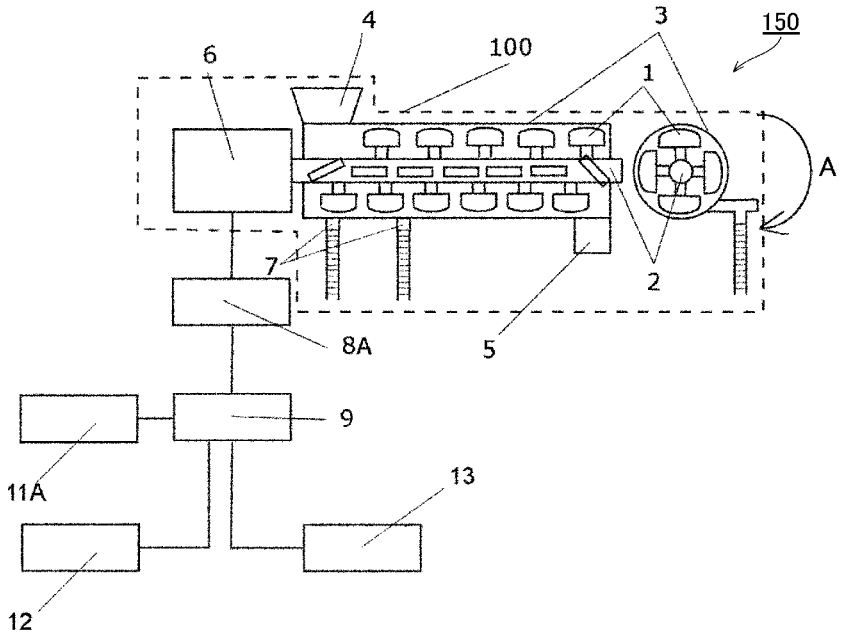
[FIG.20]
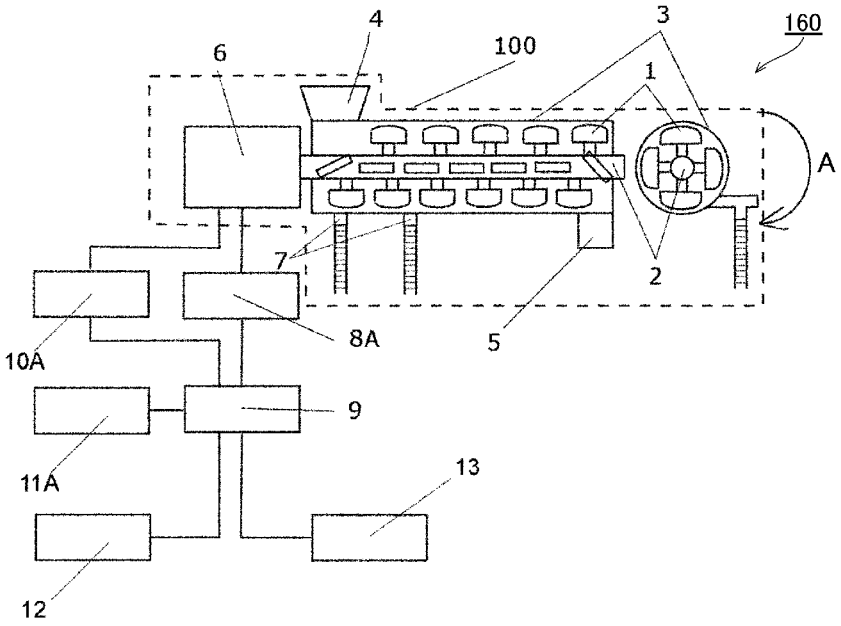

CONTINUOUS MIXING APPARATUS, SYSTEM, AND CONTINUOUS MIXING METHOD FOR POWDER/GRANULAR MATERIAL AND VISCOUS LIQUID

TECHNICAL FIELD

The present invention relates to a continuous mixing apparatus, a system, and a continuous mixing method for a powder/granular material and a viscous liquid.

BACKGROUND ART

Generally, the continuous mixing of powders and granular materials with viscous liquids, and particularly in casting technology, molding sand with a binder for molding, is widely practiced.

Patent Document 1 discloses a mixing adjusting apparatus provided with screw-type mixing paddles beneath a chute for loading sand.

Patent Document 2 discloses a mixing apparatus that makes it possible to secure paddles at a fixed angle by, with respect to a groove formed in a rotating shaft, screwing paddles having a detent part fitting the groove.

[Patent Document 1] JP H4-129544 U

[Patent Document 2] JP 2013-237012 A

SUMMARY OF THE INVENTION

Problem to be Solved by the Invention

When mixing using an apparatus such as those described above, mixing becomes difficult in cases when the particle size of the powder/granular material is small, or in cases when the viscosity of the viscous liquid is high. Patent Documents 1 and 2 do not propose an effective and appropriate method for solving the problem described above.

The problem to be solved by the present invention is to provide a continuous mixing apparatus, a system, and a continuous mixing method for a powder/granular material and a viscous liquid, capable of effectively mixing a powder/granular material and a viscous liquid in cases when the particle size of the powder/granular material is small, or in cases when the viscosity of the viscous liquid is high.

Means for Solving the Problems

The continuous mixing apparatus for a powder/granular material and a viscous liquid according to the present invention is provided with a mixing cylinder, a shaft member which is provided on a central axis of the mixing cylinder and which rotates inside the mixing cylinder, and a plurality of mixing paddles disposed on a surface of the shaft member; wherein the mixing cylinder is provided with a powder/granular material feed port on one end portion, a mixed material discharge port on the other end portion, and a viscous liquid injection unit between the powder/granular material feed port and the mixed material discharge port; the plurality of mixing paddles are disposed on the shaft member so as to form a spiral around the central axis; and the plurality of mixing paddles are, in at least a portion between the viscous liquid injection unit and the mixed material discharge port, attached so as to alternately provide a first row having an attachment angle of 5° to 60°, from the direction of the mixed material discharge port, with respect to the central axis, and a second row having an attachment angle of −5° to 5° with respect to the central axis.

Additionally, the continuous mixing method for a powder/granular material and a viscous liquid according to the present invention uses a continuous mixing apparatus provided with a mixing cylinder, a shaft member which is provided on a central axis of the mixing cylinder and which rotates inside the mixing cylinder, and a plurality of mixing paddles disposed on a surface of the shaft member; wherein the mixing cylinder is provided with a powder/granular material feed port on one end portion, a mixed material discharge port on the other end portion, and a viscous liquid injection unit between the powder/granular material feed port and the mixed material discharge port; the plurality of mixing paddles are disposed on the shaft member so as to form a spiral around the central axis; the plurality of mixing paddles are, in at least a portion between the viscous liquid injection unit and the mixed material discharge port, attached so as to alternately provide a first row having an attachment angle of 5° to 60°, from the direction of the mixed material discharge port, with respect to the central axis, and a second row having an attachment angle of −5° to 5° with respect to the central axis; and wherein the method comprises loading the powder/granular material from the powder/granular material feed port; injecting the viscous liquid from the viscous liquid injection unit; while rotating the shaft member to mix the powder/granular material and the viscous liquid, guiding the mixed material in the direction of the mixed material discharge port; and discharging the mixed material from the mixed material discharge port.

Effects of the Invention

According to the present invention, it is possible to provide a continuous mixing apparatus, a system, and a continuous mixing method for a powder/granular material and a viscous liquid, capable of effectively mixing a powder/granular material and a viscous liquid even in cases when the particle size of the powder/granular material is small, or in cases when the viscosity of the viscous liquid is high.

BRIEF DESCRIPTION OF THE DRAWINGS

FIG. 1 A schematic block diagram of the continuous mixing system shown as a first embodiment of the present invention.

FIG. 2 An explanatory diagram showing the arrangement of mixing paddles in the continuous mixing system shown as a first embodiment of the present invention.

FIG. 3 An explanatory diagram showing another arrangement of the mixing paddles.

FIG. 4 A plan view of a mixing paddle in the continuous mixing system shown as a first embodiment of the present invention.

FIG. 5 An explanatory diagram showing the attachment angle of a mixing paddle.

FIG. 6 A schematic block diagram of the continuous mixing system shown as a modified example of the first embodiment of the present invention.

FIG. 7 A schematic block diagram of the continuous mixing system shown as a second embodiment of the present invention.

FIG. 8 An operation explanatory diagram of the continuous mixing system shown as a second embodiment of the present invention.

FIG. 9 A schematic block diagram of the continuous mixing system shown as a first modified example of the second embodiment described above.

FIG. 10 An operation explanatory diagram of the continuous mixing system shown as a second modified example of the second embodiment described above.

FIG. 11 A schematic block diagram of the continuous mixing system shown as a third embodiment of the present invention.

FIG. 12 An operation explanatory diagram of the continuous mixing system shown as a third embodiment of the present invention.

FIG. 13 An operation explanatory diagram of the continuous mixing system shown as a first modified example of the third embodiment described above.

FIG. 14 An operation explanatory diagram of the continuous mixing system shown as a second modified example of the third embodiment described above.

FIG. 15 An operation explanatory diagram of the continuous mixing system shown as a third modified example of the third embodiment described above.

FIG. 16 A schematic block diagram of the continuous mixing system shown as a fourth modified example of the third embodiment described above.

FIG. 17 A schematic block diagram of the continuous mixing system shown as a fifth modified example of the third embodiment described above.

FIG. 18 A schematic block diagram of the continuous mixing system shown as a fourth embodiment of the present invention.

FIG. 19 A schematic block diagram of the continuous mixing system shown as a fifth embodiment of the present invention.

FIG. 20 A schematic block diagram of the continuous mixing system shown as a sixth embodiment of the present invention.

MODES FOR CARRYING OUT THE INVENTION

Embodiments of the present invention are described below with reference to the figures.

First Embodiment

FIG. 1 is a schematic block diagram of a continuous mixing system 110 shown as a first embodiment of the present invention. The continuous mixing system 110 is provided with a continuous mixing apparatus 100 for a powder/granular material and a viscous liquid, a driving device 6 connected to a shaft member 2 of the continuous mixing apparatus 100, a transmission device 8A that changes the rotation speed of the driving device 6, and a control device 9 that controls the transmission device 8A, the control device 9 rotating the shaft member 2 of the continuous mixing apparatus 100 at a mixing rotation speed of 600 to 1800 rpm.

First, the continuous mixing apparatus 100 will be described in detail. The continuous mixing apparatus 100 is provided with a mixing cylinder 3, a shaft member 2 which is provided on a central axis of the mixing cylinder 3 and which rotates inside the mixing cylinder 3, and a plurality of mixing paddles 1 disposed on a surface of the shaft member 2. The driving device 6 described below is connected to the shaft member 2. Additionally, the cross-sectional profile of the mixing cylinder 3 is circular in the first embodiment.

The mixing cylinder 3 is provided with a powder/granular material feed port 4 on one end portion, a mixed material discharge port 5 on the other end portion, and a viscous liquid injection unit 7 between the powder/granular material feed port 4 and the mixed material discharge port 5. The powder/granular material and the viscous liquid to be mixed are each loaded from the powder/granular material feed port 4 and the viscous liquid injection unit 7. The mixed material that has been mixed is discharged from the mixed material discharge port 5. In the first embodiment, a viscous liquid injection unit 7 is provided in two locations between the powder/granular material feed port 4 and the middle of the mixing cylinder 3, but there may be just one viscous liquid injection unit 7, or there may be three or more.

In the first embodiment, the "powder/granular material" refers to molding sand used, for example, in molding. An example of an index expressing the particle size of molding sand is the AFS particle size index. The AFS particle size index is an index based on the "Testing Procedure AFS 1106-00-S: Grain Fineness Number, AFS GFN, Calculation" defined in Mold & Core Test Handbook, 3rd Edition, published by the American Foundry Society (AFS). This index is based on measuring the particle size distribution of a sample using sieves with predetermined opening sizes and multiplying a coefficient determined for each opening size to the proportion of the sample remaining in the sieve of each opening size, then taking the sum thereof as an indicator of the opening size of a sieve in which all of the sample would remain, when assuming that the entire sample has the same particle size. The particle size becomes finer as the numerical value of the AFS particle size index becomes larger, and the particle size becomes coarser as the index becomes larger. In the first embodiment, the upper limit of the AFS particle size index is set to 120, which is a sufficiently small particle size for molding sand, but a smaller particle size may be used.

Furthermore, in the first embodiment, the "viscous liquid" refers to, for example, a binder for molding, and more particularly refers to a polymer material such as a furan resin, a phenolic resin, polyisocyanate, or water glass, and a curing agent added for curing such material, such as sulfuric acid and sulfonic acid with respect to a furan resin and an organic ester with respect to a phenolic resin or water glass. Normally, it is known that the viscosity of a furan resin is 5 mPa·s to 50 mPa·s, the viscosity of a phenolic resin is 20 mPa·s to 500 mPa·s, and the viscosity of water glass is 500 mPa·s to 1000 mPa·s. Furthermore, it is known that the viscosity of sulfonic acid and sulfuric acid is 2 mPa·s to 30 mPa·s and the viscosity of an organic ester is 2 mPa·s to 40 mPa·s. The first embodiment uses a viscous liquid having a viscosity of 2 mPa·s to 1000 mPa·s, which is a high viscosity as a binding material, but others may be used.

A polymer material and the curing agent are each added at a ratio of about 0.05% to about 10% by mass with respect to the powder/granular material. This addition amount differs depending on the combination of each polymer material and the necessary curing agent, and also differs depending on the ultimately required qualities, such as the strength, and the time curing, of the mixed material, so the addition amount is arbitrarily adjusted according to the atmospheric temperature and the like when mixing. As forms of curing agents, besides those added as the viscous liquid, there are those such as $SO_2$ with respect to furan resin, methyl formate with respect to a phenolic resin, $CO_2$ with respect to a phenolic resin and water glass, and triethylamine with respect to a phenolic resin and polyisocyanate, which accelerate the effect by being ventilated as a gas after mixing the polymer material and the powder/granular material. With respect to such additives, a method should be used wherein only the polymer material is mixed with the powder/granular material using the method, apparatus and system according to the first embodiment, after which a separate apparatus is used for ventilating the gas.

Additionally, there are cases wherein curing agents such as metal silicon, amorphous silicon, ferrosilicon, and dicalcium silicate with respect to water glass are added in a powdered form, but in such cases, a method should be used wherein a powdered curing agent is added beforehand to be an appropriate amount with respect to the powder/granular material before reaching the powder/granular material feed port 4, after which the method, apparatus and system according to the first embodiment is used for mixing with the viscous liquid.

In order to effectively mix a powder/granular material and a viscous liquid such as those described above, the first embodiment has a structure wherein the arrangement and the attachment angle and the like of the mixing paddles 1 with respect to the shaft member 2 are characterized in various ways. The structures will be explained in detail below.

First, the number of rows of the mixing paddles 1 will be described. FIG. 2 is a diagram showing the relationship between the shaft member 2 (2A, 2B, 2C, 2D) and the mixing paddles 1 (1A, 1B, 1C, 1D). In the first embodiment, the shaft member 2 is a solid cylinder with a circular cross-section provided with four substantially identical rectangular sides 2A, 2B, 2C, and 2D in the lengthwise direction. These four sides 2A, 2B, 2C, and 2D are shown separately in FIG. 2.

A plurality of mixing paddles 1 are provided, with respect to the central axis of the shaft member 2, spaced apart at a fixed angle in the circumferential direction of the central axis. Thus, the mixing paddles 1 are disposed so as to form a plurality of rows 2A, 2B, 2C, and 2D extending in the lengthwise direction of the shaft member 2. In the first embodiment, the fixed angle is 90°, and the mixing paddles 1 are provided so as to rise perpendicularly from each of the sides 2A, 2B, 2C, and 2D. Thus, the mixing paddles 1 are disposed so as to form the four rows 2A, 2B, 2C, and 2D with respect to the shaft member 2. In the first embodiment, when the shaft member 2 is viewed from a fixed direction during rotation, the shaft member 2 rotates in a rotational direction A so that each of the sides 2A, 2B, 2C, and 2D of the shaft member 2 appear in the order of 2A-2B-2C-2D, as shown in FIG. 2.

If the number of rows is, for the reasons below, any other than four rows as shown in FIG. 2, six rows or eight rows is preferable. When there is one row or two rows, there is substantial occurrence of uneven mixing and lumps, particularly when the particle size of the powder/granular material is small and/or the viscosity of the viscous liquid is high. Additionally, when the number of rows is odd, there is a risk that the shaft member 2 will vibrate during mixing. Furthermore, in a case when there are ten rows or more, the number of mixing paddles 1 will become too large and result in an unnecessary enlargement of the device as a whole, and the inertial resistance that occurs during mixing will increase, requiring the power of the driving device 6 to be increased more than is necessary.

Additionally, the angles between the rows 2A, 2B, 2C, and 2D are preferably fixed, as described above. If the angles between the rows are not the same, mixing is not performed efficiently and unevenness and lumps occur. Additionally, if, for example, an electric motor is used as the driving device 6, fluctuations of the load current will occur, and that is not efficient in terms of power transmission. Furthermore, because the load with respect to the shaft member 2 will become imbalanced, the shaft member 2 will vibrate, so there are problems such as the shaft member 2 breaking in a worst-case scenario.

The mixing paddles 1 are disposed so as to form the four rows 2A, 2B, 2C, and 2D as described above, while also being disposed, in the first embodiment, to form a spiral around the central axis on the shaft member 2. More specifically, the mixing paddles 1, as shown in FIGS. 1 and 2, are provided so that a spiral 101, formed by connecting the vertices of the mixing paddles 1 from a powder/granular material feed port 4 side $S_1$ to a mixed material discharge port 5 side $S_2$, draws a curve that extends in the forward direction as the shaft member 2 is rotated, that is, in the same direction as the rotational direction A of the shaft member 2. By being disposed so as to form a spiral in this manner, an effect is yielded, through the mixing paddles 1, in which the powder/granular material, or the mixed material comprising the powder/granular material and the viscous liquid, is propelled from the powder/granular material feed port 4 side $S_1$ to the mixed material discharge port 5 side $S_2$. Furthermore, the load of the driving device 6 can substantially be reduced, so a driving device 6 with a lower power can be selected. Meanwhile, when mixing the powder/granular material and the viscous liquid, there is a need to perform mixing while retaining both for a certain extent of time, so there is a need to change the extent of retention by adjusting the angle of the mixing paddle 1. This angular adjustment will be described below.

In contrast, as illustrated in FIG. 3, it is possible to contemplate providing the mixing paddles 1 so that a spiral 102 connecting the vertices of the mixing paddles 1 and the rotational direction A of the shaft member 2 are opposite to each other, that is, a curve that extends in the direction opposite to the feeding direction when the shaft member 2 is rotated. However, in this case, the powder/granular material or the mixed material comprising the powder/granular material and the viscous liquid is hardly propelled by rotating the shaft member 2, and is propelled by pushing out the powder/granular material or the mixed material comprising the powder/granular material and the viscous liquid that is retained in the mixing cylinder entirely by sequentially loading the powder/granular material from the powder/granular material feed port. As such, the load of the driving device 6 will increase, and as illustrated in FIG. 2, when compared with the condition of the mixing paddles 1 disposed so as to draw the spiral 101 that extends in the feeding direction when the shaft member 2 is rotated, there is a problem in that there is no choice but to select a driving device 6 with a very high power.

Next, the shape of the mixing paddles 1 will be described. FIG. 4 is a plan view of a mixing paddle 1. Each of the plurality of mixing paddles 1 is provided with a plate 1*a* and a male screw part S. The male screw part S is bonded to one side of the plate 1*a*, and by screwing the male screw part S into a female threaded part, not shown, provided on the shaft member 2, the mixing paddle 1 is attached to the shaft member 2. That is, in FIG. 4, the shaft member 2 is positioned in the downward direction.

The plate 1*a* is provided with a rectangular part 1*b* positioned on the shaft member side and an arc part 1*c* provided on the side of the rectangular part 1*b* opposite to the shaft member and having a tip formed in an arc shape having a radius of curvature equal to that of the mixing cylinder 3. Such an arrangement allows, when screwing the mixing paddles 1 into the shaft member 2, the gap between the mixing paddles 1 and the mixing cylinder 3 to be made as narrow as possible, for example, 5 mm, so that a deposition layer of the mixed material comprising the powder/granular material and the viscous liquid on the inner walls of the mixing cylinder 3 is formed with a uniform thickness that is as thin as possible. The deposition layer of the mixed material comprising the powder/granular material and the viscous liquid also acts as a lining for preventing abrasion of the mixing cylinder 3, but inhibits progress of the mixed material comprising the powder/granular material and the viscous liquid if it is thicker than necessary, leading to reduced mixability, and greater resistance to the mixing paddles 1, thereby increasing the load on the driving device 6. According to an arrangement such as that described above, it becomes possible to make the thickness of the deposition layer sufficiently thin, such as 5 mm.

The rectangular part 1*b* is formed so that the ratio of the length L, in the diameter direction of the mixing cylinder 3 from the central axis of the mixing cylinder 3, to the width W, in the direction orthogonal to the diameter direction, is 1:0.5 to 1:3. This is based on the reasons below. The higher the rotation speed of the shaft member 2 becomes, the more there is a need to enlarge the area of the plates 1*a* touching the mixed material comprising the powder/granular material and the viscous liquid and to perform mixing in a short period of time. However, if the ratio of the length L and the width W of the plate 1*a* exceeds 1:3, the problem of an increase in the load on the driving device 6 due to enlarging the area becomes greater than the effect of improvement of mixability. Meanwhile, if the ratio of the length L and the width W becomes smaller than 1:0.5, the necessary load is not transferred from the driving device 6 to the mixed material comprising the powder/granular material and the viscous liquid, causing the mixing paddles 1 to undergo idle rotation.

Next, the attachment angles of the mixing paddles 1 will be described. FIG. 5 shows the relationship between the angle of the mixing paddle 1, the rotational direction A of the shaft member 2, and the progression direction of the powder/granular material or the mixed material comprising the powder/granular material and the viscous liquid. In the mixing paddle 1, the plate 1*a* shown in FIG. 4 is used as the mixing surface. The "angle" of the mixing paddle 1 refers to the attachment angle with respect to the central axis, from the direction of the mixed material discharge port 5, that is, the angle formed by the centerline of the mixing paddle 1, which is configured to be parallel to the mixing surface, and the centerline of the shaft member 2. When the mixing paddle 1 is screwed, by means of the male screw part S shown in FIG. 4, to the shaft member 2 so that the mixing surface is parallel to the shaft member 2, the angle of the mixing paddle 1 is 00°.

The angle of the mixing paddle 1 that is formed when the mixed material discharge port 5 side of the mixing paddle 1 is inclined in a direction opposite to the rotational direction A of the shaft member 2 is defined to be a positive angle, which changes to 30°, 45°, and 60° as shown in FIG. 5, and is 90° when the mixing paddle 1 forms a right angle with the centerline of the shaft member 2. When the mixing paddle 1 is further rotated, the angle of the mixing paddle 1 changes to 120° and 150°, and ultimately, when screwed with the male screw part S so that the mixing surface is once again parallel to the shaft member 2, the angle of the mixing paddle 1 becomes 180°. However, in the first embodiment, the mixing paddle 1 does not have different front and back sides, so when the angle of the mixing paddle 1 is 0° and 180°, the states thereof are the same in structure and operation.

In a state in which the angle of the mixing paddle 1 is −5° to 5°, for example, 0°, the powder/granular material or the mixed material comprising the powder/granular material and the viscous liquid make little progress, and are mixed by the mixing paddle 1. As the angle increases from this state, an effect is added in which the powder/granular material or the mixed material comprising the powder/granular material and the viscous liquid is propelled to the mixed material discharge port 5 side. When the angle is 45°, the mixing effect and the propulsion effect become equal. When the angle exceeds 45°, the mixing and propulsion effects weaken, and the time of retention of the powder/granular material or the mixed material comprising the powder/granular material and the viscous liquid increases. When the angle is 90°, the mixing paddle 1 undergoes idle rotation, and the powder/granular material or the mixed material comprising the powder/granular material and the viscous liquid are fully retained in the mixing cylinder 3. When the angle exceeds 90°, the powder/granular material or the mixed material comprising the powder/granular material and the viscous liquid starts being fed backwards and the mixing effect simultaneously increases, and when the angle is 135°, the mixing effect and the back-feeding effect become equal. When the angle exceeds 135°, the back-feeding effect weakens and the mixing effect increases, and when the angle is 180°, that is, 0°, the propulsion effect again weakens the most, and the material is mixed by the mixing paddle 1 in a state of retention in the mixing cylinder 3. In this manner, the effects on the powder/granular material or the mixed material comprising the powder/granular material and the viscous liquid differ depending on the angle of the mixing paddle 1, so the angle that is selected for the mixing process becomes an important factor.

In the first embodiment, as shown in FIG. 1 and FIG. 2, the plurality of mixing paddles 1A near the powder/granular material feed port 4 are attached such as to have an attachment angle of 5° to 60°, from the direction of the mixed material discharge port 5, with respect to the central axis. Near the powder/granular material feed port 4, the powder/granular material loaded into the mixed material discharge port 4 is received by the shaft member 2 and the mixing paddles 1A positioned immediately below the powder/granular material feed port 4, and while being fed in the direction of the mixed material discharge port 5, is mixed for the first time with viscous liquid injected from a viscous liquid injection unit 7. At this stage, there is a need to rapidly propel the powder/granular material and the viscous liquid loaded from the outside while mixing, and if the powder/granular material or the mixed material comprising the powder/granular material and the viscous liquid is retained here, blockage occurs at the powder/granular material feed port 4. As such, the mixing paddles 1A near the powder/granular material feed port 4 are configured to be provided with an arbitrary angle in the range of 5° to 60°, which are angles with both the effects of propulsion and mixing. When the angle is larger than 60°, a sufficient propulsion effect is not obtained and this leads to retention. Likewise, when the angle is below 5°, as described above, powder/granular material or the mixed material comprising the powder/granular material and the viscous liquid make little progress, and a sufficient propulsion effect is not obtained.

In the first embodiment, the attachment angle of the mixing paddles 1A near the powder/granular material feed port 4 is 5° to 60° as described above, but is more preferably set as 15° to 60°. By making the lower limit 15°, it becomes possible to obtain the effect of greater propulsion.

Additionally, a plurality of mixing paddles 1B and 1C are, in at least a part between the viscous liquid injection unit 7 and the mixed material discharge port 5, attached so as to alternately provide first rows 2A and 2C having an attachment angle of 5° to 60°, from the direction of the mixed material discharge port 5, with respect to the central axis, and second rows 2B and 2D having an attachment angle of −5° to 5° with respect to the central axis. In FIG. 2, the mixing paddles 1 which have an attachment angle of 5° to 60° and which are attached in the first rows 2A and 2C are shown as the mixing paddles 1B, and the mixing paddles 1 which have an attachment angle of −5° to 5° and which are attached to the second rows 2B and 2D are shown as the mixing paddles 1C.

The mixing paddles 1B and 1C perform mixing of the powder/granular material and the viscous liquid. In this portion, mainly in the area around the center of the mixing cylinder 3, there is a need to retain the powder/granular material and the viscous liquid in the mixing cylinder 3 and to mix the same while propelling the mixed material comprising the powder/granular material and the viscous liquid to the mixed material discharge port 5 side. The proportion of the mixing and propulsion effects changes depending on the angle of mixing paddles 1 as described above, so in the first embodiment, in order to make both mixing and propulsion be in the best state, the mixing paddles 1 are disposed so as to alternate the second rows 2B and 2D having an attachment angle of −5° to 5° and the first rows 2A and 2C having an arbitrary angle of 5° to 60°. With such an arrangement, mixing is performed while minimizing the propulsion effect at the second rows 2B and 2D having an angle of −5° to 5°, and meanwhile, propulsion is performed while mixing at the first rows 2A and 2C having an arbitrary angle in the range of 5° to 60°, so a good mixing effect is obtained. When the angle is larger than 60° in the first rows 2A and 2C, the effect of sufficient propulsion is not obtained and this leads to retention. Likewise, when the angle is below 5°, the powder/granular material or the mixed material comprising the powder/granular material and the viscous liquid make little progress, and the effect of sufficient propulsion is not obtained. Accordingly, the suitability of an arbitrary angle in the range of 5° to 60° is the same as described above.

In the first embodiment, the attachment angle of the mixing paddles 1B in the first rows 2A and 2C is 5° to 60° as described above, but like the attachment angle of the mixing paddles 1A near the powder/granular material feed port 4, is more preferably set as 15° to 60°. By making the lower limit 15°, it becomes possible to obtain a greater propulsion effect.

Finally, a plurality of mixing paddles 1D near the mixed material discharge port 5 are attached so as to have an attachment angle of 120° to 150°, from the direction of the mixed material discharge port 5, with respect to the central axis. Near the mixed material discharge port 5, if the mixing paddle 1 is provided with an angle having the effect of propulsion, the mixed material comprising the powder/granular material and the viscous liquid is discharged from the mixed material discharge port 5 without being sufficiently mixed, so there is a need to fully retain and mix the mixed material comprising the powder/granular material and the viscous liquid, and push it out by means of the successively loaded mixed material of the powder/granular material and the viscous liquid. As such, the angle of the mixing paddle 1 is set at an arbitrary angle within the range of 120° to 150° having the effect of back-feeding. When the angle is smaller than 120°, or is larger than 150°, the effect of back-feeding required at this stage cannot be sufficiently obtained.

As shown in FIG. 1, the driving device 6 is connected to the end of the shaft member 2 on the side of the powder/granular material feed port 4. The shaft member 2 is rotated by the driving device 6. In the first embodiment, the driving device 6 is an AC motor, but can also be a DC motor as described below.

The transmission device 8A changes the rotation speed of the driving device 6. The driving device 6 is an AC motor as described above, so to change the rotation speed of the AC motor, the transmission device 8A is composed of an AC/DC converter circuit, a voltage smoothing circuit, and a DC/AC converter circuit, and is preferably a frequency/voltage converter that changes the frequency and voltage of a power source, not shown, to be applied to the driving device 6. By using such a transmission device 8A, when the driving device 6 is an AC motor, it becomes possible to easily change the rotation speed of the driving device 6.

The control device 9 controls the transmission device 8A. In the first embodiment, the control device 9 rotates the shaft member 2 at a mixing rotation speed of 600 to 1800 rpm.

The rotation speed of the shaft member 2 is preferably higher the smaller the particle size of the powder/granular material, and/or the higher the viscosity of the viscous liquid. On the other hand, the load on the shaft member 2 becomes larger the higher the rotation speed becomes, so a higher power must be chosen for the driving device 6, and furthermore, the properties change if the temperature of the mixed material comprising the powder/granular material and the viscous liquid rises through mixing, so higher is not necessarily better, and thus there is a need to set an upper limit. Additionally, the rotation speed can be lower the larger the particle size of the powder/granular material, and/or the lower the viscosity of the viscous liquid. However, there is a need to set a lower limit because the mixing will not be sufficient if the rotation speed is too low.

Here, as described above, the shaft member 2 is rotated at a specific rotation speed in the range of 600 rpm to 1800 rpm. The reason for this is as described below. That is, unevenness and lumps occur at rotation speeds below 600 rpm, and sufficient mixing is not performed. Furthermore, the power of the driving device 6 must be very high when the rotation speed is higher than 1800 rpm, and the properties will change when the temperature of the mixed material comprising the powder/granular material and the viscous liquid rises through mixing.

Next, the continuous mixing method for the powder/granular material and the viscous liquid using the continuous mixing system 110 will be explained. The continuous mixing method in the first embodiment is a method for mixing a powder/granular material and a viscous liquid, using a continuous mixing apparatus 100 provided with a mixing cylinder 3, a shaft member 2 provided on the central axis of the mixing cylinder 3 and which rotates inside the mixing cylinder 3, and a plurality of mixing paddles 1 disposed on a surface of the shaft member 2, wherein the mixing cylinder 3 is provided with a powder/granular material feed port 4 on one end, a mixed material discharge port 5 on the other end, and a viscous liquid injection unit 7 between the powder/granular material feed port 4 and the mixed material discharge port 5, the plurality of mixing paddles 1 are disposed on the shaft member 2 so as to form a spiral 101 around the central axis in the same direction as the rotational direction A of the shaft member 2, and the plurality of mixing paddles 1, in at least a portion between the viscous liquid injection unit 7 and the mixed material discharge port 5, are attached so as to alternately provide first rows 2A and 2C having an attachment angle of 5° to 60°, from the direction of the mixed material discharge port 5, with respect to the central axis, and second rows 2B and 2D having an attachment angle of −5° to 5° with respect to the central axis, and wherein the method comprises feeding the powder/granular material from the powder/granular material feed port 4, injecting viscous liquid from the viscous liquid injection unit 7, while rotating the shaft member 2 to mix the powder/granular material and the viscous liquid, guiding the mixed material in the direction of the mixed material discharge port 5, and discharging the mixed material from the mixed material discharge port 5.

First, the control device 9 sends an instruction to the transmission device 8A to rotate the driving device 6 at a mixing rotation speed of 600 to 1800 rpm. The transmission device 8A receives the instruction from the control device 9, and rotates the driving device 6 at a rotation speed of 600 to 1800 rpm. As a result, the shaft member 2 connected to the driving device 6 rotates at a mixing rotation speed of 600 to 1800 rpm.

Next, the powder/granular material is loaded from the powder/granular material feed port 4, and the viscous liquid is injected from the viscous liquid injection unit 7. The loaded powder/granular material and viscous liquid is mixed by the mixing paddles 1A positioned near the powder/granular material feed port 4, as shown in FIG. 2. The mixing paddles 1A are attached at an attachment angle of 5° to 60°, so the powder/granular material and the viscous liquid is rapidly propelled while being mixed.

The powder/granular material and the viscous liquid and the mixed material thereof, after being propelled by the mixing paddles 1A from near the mixed material discharge port 4, arrive at and are mixed further by the mixing paddles 1B and 1C positioned between the viscous liquid injection unit 7 and the mixed material discharge port 5. The mixing paddles 1B and 1C are attached so as to alternately provide the first rows 2A and 2C having an attachment angle of 5° to 60°, from the direction of the mixed material discharge port 5, with respect to the central axis, and the second rows 2B and 2D having an attachment angle of −5° to 5° with respect to the central axis, so the powder/granular material and the viscous liquid are retained inside the mixing cylinder 3 and propelled to the mixed material discharge port 5 side while mixing the materials.

The powder/granular material and the viscous liquid and the mixed material thereof, propelled by the mixing paddles 1B and 1C, arrive at and are mixed further by the mixing paddles 1D positioned near the mixed material discharge port 5. The mixing paddles 1D are attached at an attachment angle of 120° to 150°, from the direction of the mixed material discharge port 5, with respect to the central axis, so the mixed material comprising the powder/granular material and the viscous liquid are fully retained and mixed while being pushed out by the successively loaded mixed material of the powder/granular material and the viscous liquid, and discharged from the mixed material discharge port 5.

Next, the functions and effects of the continuous mixing apparatus 100, continuous mixing system 110 and continuous mixing method described above will be explained.

By arranging the mixing paddles 1 as described above, the powder/granular material and the viscous liquid loaded from the outside is rapidly propelled while being mixed by the mixing paddles 1A, and then mixing is performed while minimizing the propulsion effect by the second rows 2B and 2D of the mixing paddles 1C having an angle of −5° to 5°, and on the other hand, propulsion is performed while mixing by rows 2A and 2C of the mixing paddles 1C having an arbitrary angle in the range of 5° to 60°, and finally, the mixed material comprising the powder/granular material and the viscous liquid is fully retained while being mixed by the mixing paddles 1D, while being pushed out by the successively loaded mixed material of the powder/granular material and the viscous liquid and discharged, and when the particle size of the powder/granular material is small, and/or when the viscosity of the viscous liquid is high, it is possible to effectively mix the powder/granular material and the viscous liquid.

Additionally, the rotation speed of the shaft member 2 is 600 to 1800 rpm, so it is possible to achieve sufficient mixing and prevent unevenness and lumps and appropriately suppress the power of the driving device 6.

Additionally, the mixing paddles 1 are aligned in four rows, and the angles between rows 2A, 2B, 2C, and 2D are the same, so it is possible to prevent the occurrence of mixing unevenness and lumps, vibration of the shaft member 2, and unnecessary enlargement of the device as a whole.

Additionally, as shown in FIG. 4, the plates 1*a* of the mixing paddles 1 are each provided with a rectangular part 1*b* positioned on the shaft member side and an arc part 1*c* provided on the side of the rectangular part 1*b* opposite to the shaft member and having a tip formed in an arc shape having a radius of curvature equal to that of the mixing cylinder 3. Therefore, when screwing the mixing paddles 1 into the shaft member 2, the gap between the mixing paddle 1 and the mixing cylinder 3 can be made as narrow as possible so that a deposition layer of the mixed material comprising the powder/granular material and the viscous liquid on the inner walls of the mixing cylinder 3 can be formed with a uniform thickness that is as thin as possible. This allows the mixed material comprising the powder/granular material and the viscous liquid to be easily progressed, making it possible to reduce the load on the driving device 6.

Additionally, the rectangular part 1*b* of the plate 1*a* of the mixing paddle 1 is formed so that the ratio of the length L in the diameter direction of the mixing cylinder 3 from the central axis of the mixing cylinder 3 to the width W in the direction orthogonal to the diameter direction is 1:0.5 to 1:3. This appropriately transmits the load from the driving device 6, making it possible to mix the material effectively. Additionally, inertial resistance does not excessively increase even if the rotation speed of the shaft member 2 is raised, so the driving force of the driving device 6 can be efficiently utilized for mixing the powder/granular material and the viscous liquid.

Modified Example of First Embodiment

Next, a modified example of the continuous mixing system 110 shown as the first embodiment described above will be explained using FIG. 6. FIG. 6 is a schematic block diagram of the continuous mixing system 111 shown as a modified example of the first embodiment described above. The continuous mixing system 111 in the modified example differs from the continuous mixing system 110 described above in that the transmission device 8B is a mechanical transmission device that is inserted between the driving device 6 and the shaft member 2.

Of course, the modified example exhibits effects similar to those of the first embodiment described above.

In the modified example, furthermore, the transmission device 8B is a mechanical transmission device inserted between the shaft member 2 and the driving device 6, so even when the torque of the shaft member 2 is very large, it is possible to ensure that the driving force from the driving device 6 is transmitted.

Second Embodiment

Next, the continuous mixing system 120 shown as a second embodiment will be explained using FIG. 7. FIG. 7 is a schematic block diagram of the continuous mixing system 120 shown as the second embodiment. As compared with the continuous mixing system 110 explained as the first embodiment using FIG. 1, an electrical forward-reverse rotation device 10A has been added to the continuous mixing system 120 in the modified example.

The continuous mixing system 120 is further provided with the forward-reverse rotation device 10A which is controlled by the control device 9 and which modifies the rotational direction A of the driving device 6. The forward-reverse rotation device 10A converts the polarity between the power supply, not shown, and the driving device 6 based on an instruction from the control device 9, thereby forward-rotating or reverse-rotating the driving device 6.

When mixing of the powder/granular material and the viscous liquid is to be performed with the mixing cylinder 3 in an initially empty state, the mixed material comprising the powder/granular material and the viscous liquid does not fill the mixing cylinder 3 during the period after the loading of the powder/granular material and the injection of the viscous liquid into the mixing cylinder 3 has been initiated until discharge of the mixed material comprising the powder/granular material and the viscous liquid from the mixed material discharge port 5 begins, so it is preferable to improve the mixing efficiency during that period. Therefore, during the introduction period from the time at which mixing is begun with the mixing cylinder 3 in an empty state until the mixed material fills the mixing cylinder 3, the control device 9 reverse-rotates the shaft member 2 at least once, for a time $T_1$ of 0.2 to 10 seconds. This temporarily back-feeds the mixed material comprising the powder/granular material and the viscous liquid, retaining and mixing the mixed material comprising the powder/granular material and the viscous liquid in the mixing cylinder 3, so the mixing efficiency increases. When the time $T_1$ for performing reverse-rotation is shorter than 0.2 seconds, the retention time is too short and the effect cannot be obtained, whereas on the other hand, when the time is longer than 10 seconds, the mixed material comprising the powder/granular material and the viscous liquid blocks the mixing cylinder 3, so it is preferable to set the time to an arbitrary period in the range of 0.2 seconds to 10 seconds as described above. Note that it is preferable for the number of reverse rotations to be once or a plurality of times.

In the second embodiment, this reverse-rotation time $T_1$ is 1 second. FIG. 8 schematically shows the period from when the mixing of the powder/granular material and the viscous liquid has been initiated until the mixing cylinder 3 is filled with the mixed material comprising the powder/granular material and the viscous liquid, and the times of implementation of the forward rotation and reverse rotation of the shaft member 2. For example, as shown in FIG. 8, the shaft member 2 is forward-rotated simultaneously with mixing initiation $T_a$, the shaft member 2 is 1 second later reverse-rotated for 1 second, the shaft member 2 is again normally rotated 1 second thereafter, and after a time $T_b$, at which the mixed material comprising the powder/granular material and the viscous liquid is discharged from the mixed material discharge port 5 of the shaft member 2, only forward rotation is performed.

In the continuous mixing method in the second embodiment, during the introduction period from the time at which mixing is initiated with the mixing cylinder 3 in an empty state until the mixing cylinder 3 is filled, the shaft member 2 is reverse-rotated at least once, for a time $T_1$ of 0.2 to 10 seconds, for example, 1 second. That is, the continuous mixing method in the second embodiment is similar to the continuous mixing method explained in the first embodiment, except that the shaft member 2 is reverse-rotated during the period after the control device 9 rotates the shaft member 2, the powder/granular material is loaded from the powder/granular material feed port 4, and the viscous liquid is injected from the viscous liquid injection unit 7, until the mixed material comprising the powder/granular material and the viscous liquid begins to be discharged from the mixed material discharge port 5 as described above.

Of course, the second embodiment exhibits effects similar to those of the first embodiment described above.

In the second embodiment, furthermore, the shaft member 2 is reverse-rotated in a state in which the mixed material comprising the powder/granular material and the viscous liquid has not filled the mixing cylinder 3, and uniform mixing is not easy, thereby retaining the mixed material comprising the powder/granular material and the viscous liquid inside the mixing cylinder 3 for a long time. This makes it possible to sufficiently and uniformly perform mixing even in a state in which uniform mixing is not easily achieved.

Additionally, the forward-reverse rotation device 10A is electrical, so it is possible to perform all of the controls electrically, and the structure of the continuous mixing system 120 can be simplified.

First Modified Example of Second Embodiment

Next, a first modified example of the continuous mixing system 120 shown as the second embodiment described above will be explained using FIG. 9. FIG. 9 is a schematic block diagram of the continuous mixing system 121 shown as the first modified example of the second embodiment described above. The continuous mixing system 121 in the modified example differs from the continuous mixing system 120 described above in that the forward-reverse rotation device 10B is a mechanical forward-reverse rotation device that is inserted between the driving device 6 and the shaft member 2.

A driving device 6 is connected to a control device 9 through the mechanical forward-reverse rotation device 10B. By an instruction from control device 9, the mechanical forward-reverse rotation device 10B reverses the rotational direction A of the driving device 6 and the shaft member 2, thereby controlling the forward rotation or reverse rotation of the shaft member 2.

Of course, the modified example exhibits effects similar to those of the first and second embodiment described above.

In the modified example, furthermore, the forward-reverse rotation device 10B is a mechanical forward-reverse rotation device inserted between the shaft member 2 and the driving device 6, so even when the torque of the shaft member 2 is very large, it is possible to ensure that the driving force from the driving device 6 is transmitted.

Second Modified Example of Second Embodiment

Next, a second modified example of the continuous mixing system 120 shown as the second embodiment described above will be explained using FIG. 10. FIG. 10 schematically shows the times during which forward rotation and reverse rotation of the shaft member 2 are implemented during the period from when the supply of the powder/granular material and the viscous liquid has stopped at a time $T_c$, which is when the mixing cylinder 3 has been filled with the mixed material comprising the powder/granular material and the viscous liquid, until all of the mixed material comprising the powder/granular material and the viscous liquid retained in the mixing cylinder 3 is discharged from the mixed material discharge port 5 at a time $T_d$. The continuous mixing system in the modified example differs from the continuous mixing system 120 described above in that the period for reverse-rotating the shaft member 2 is not the period from when the loading of the powder/granular material and injecting of the viscous liquid to the mixing cylinder 3 has been initiated until the mixed material comprising the powder/granular material and the viscous liquid begins to be discharged from the mixed material discharge port 5, but the period from when the supply of the powder/granular material and the viscous liquid is stopped until all of the mixed material comprising the powder/granular material and the viscous liquid retained in the mixing cylinder 3 is discharged from the mixed material discharge port 5.

In the period from when the supply of the powder/granular material and the viscous liquid is stopped in a state in which the mixing cylinder 3 is filled with the mixed material comprising the powder/granular material and the viscous liquid until all of the mixed material comprising the powder/granular material and the viscous liquid retained in the mixing cylinder 3 is discharged from the mixed material discharge port 5, similar to the second embodiment, the mixed material comprising the powder/granular material and the viscous liquid has not filled the mixing cylinder 3, so it is preferable to improve the mixing efficiency. Therefore, in the termination period after the supply of the powder/granular material has stopped, the control device 9 reverse-rotates the shaft member 2 at least once, for a time $T_3$ of 0.2 to 10 seconds. This temporarily back-feeds the mixed material comprising the powder/granular material and the viscous liquid, retaining and mixing the mixed material comprising the powder/granular material and the viscous liquid in the mixing cylinder 3, so the mixing efficiency increases. When the time $T_3$ for carrying out reverse-rotation is shorter than 0.2 seconds, the retention time is too short and the effect cannot be obtained, whereas on the other hand, when the time is longer than 10 seconds, the mixed material comprising the powder/granular material and the viscous liquid blocks the mixing cylinder 3, so as described above, it is preferable to set the time to an arbitrary period in the range of 0.2 seconds to 10 seconds. Note that it is preferable for the reverse rotation to be implemented once or multiple times.

In the modified example, this reverse-rotation time $T_3$ is 3 seconds. For example, as shown in FIG. 10, the shaft member 2 is forward-rotated while the control device 9 simultaneously stops the supply of the powder/granular material and the viscous liquid to the mixing cylinder 3, the shaft member 2 is 3 seconds later reverse-rotated for 3 seconds, and then the shaft member 2 is again normally rotated for 3 seconds. Thus, forward rotation and reverse rotation are repeated during the period from when the supply of the powder/granular material and the viscous liquid has stopped in a state in which the mixing cylinder 3 has been filled with the mixed material comprising the powder/granular material and the viscous liquid, until all of the mixed material comprising the powder/granular material and the viscous liquid retained in the mixing cylinder 3 is discharged from the mixed material discharge port 5.

In the continuous mixing method in the modified example, during the termination period after the supply of the powder/granular material is stopped in a state in which the mixed material has filled the mixing cylinder 3, the shaft member 2 is reverse-rotated at least once, for a time $T_3$ of 0.2 to 10 second, for example, 3 seconds. That is, the continuous mixing method in the modified example is similar to the continuous mixing method explained in the first embodiment, except that the shaft member 2 is reverse-rotated in the above-described manner during the period from when the supply of the powder/granular material and the viscous liquid is stopped, until all of the mixed material comprising the powder/granular material and the viscous liquid retained in the mixing cylinder 3 is discharged from the mixed material discharge port 5.

Of course, the modified example exhibits effects similar to those of the first and second embodiments described above.

Third Embodiment

Next, a continuous mixing system 130 shown as a third embodiment will be explained using FIG. 11. FIG. 11 is a schematic block diagram of the continuous mixing system 130 shown as the third embodiment. As compared with the continuous mixing system 110 explained as the first embodiment using FIG. 1, a determination device 11B has been added to the continuous mixing system 130 in the modified example.

The continuous mixing system 130 is further provided with the determination device 11B that determines whether or not mixed material has filled the mixing cylinder 3. The determination device 11B is disposed near the mixed material discharge port 5 of the mixing cylinder 3, and in the third embodiment, is a detector that senses that the mixed material comprising the powder/granular material and the viscous liquid has been discharged from the mixed material discharge port 5. The determination results of the determination device 11B are transmitted to the control device 9.

As described in the second embodiment, when the powder/granular material and the viscous liquid are mixed with the mixing cylinder 3 in an initially empty state, the mixing cylinder 3 is not filled with the mixed material comprising the powder/granular material and the viscous liquid during the period from when the loading of the powder/granular material and the injection of the viscous liquid into the mixing cylinder 3 begin until the mixed material comprising the powder/granular material and the viscous liquid begin to be discharged from the mixed material discharge port 5, so it is preferable to improve the mixing efficiency. In the third embodiment, the mixing efficiency is improved by rotating the shaft member 2 at a low rotation speed. Specifically, in the introduction period after the mixing has been initiated with the mixing cylinder 3 empty until the determination device 11B determines that the mixed material has filled the mixing cylinder 3, the control device 9 rotates the shaft member 2 at an introduction rotation speed of 150 to 400 rpm. After the determination device 11B determines that the mixing cylinder 3 has been filled with the mixed material, the rotation speed is modified to a mixing rotation speed in the range of 600 rpm to 1800 rpm as described above. This allows for extending the time during which the mixed material comprising the powder/granular material and the viscous liquid is retained in the mixing cylinder 3 in the introduction period, so the mixing efficiency increases. A rotation speed lower than 150 rpm would not be practical as the mixing efficiency would be too low, and furthermore, a rotation speed higher than 400 rpm would prevent the mixed material comprising the powder/granular material and the viscous liquid from sufficiently filling the mixing cylinder 3, so it is preferable for the introduction rotation speed to be 150 to 400 rpm as described above.

FIG. 12 shows the relationship between the time from mixing initiation and the rotation speed of the shaft member 2 in the third embodiment. The control device 9 sets the transmission device 10A and operates the driving device 6 so that the shaft member 2 is rotated at an introduction rotation speed $R_a$, that is, a specified rotation speed in the range of 150 rpm to 400 rpm, from a time $T_a$ at which the mixing of the powder/granular material and the viscous liquid is initiated with the mixing cylinder 3 empty, until a time $T_e$ when the determination device 11B is activated, and so that the shaft member 2 is rotated at a mixing rotation speed $R_b$, that is, a rotation speed in the specified range of 600 rpm to 1800 rpm, after the mixed material comprising the powder/granular material and the viscous liquid fills the mixing cylinder 3 and the determination device 11B is activated.

In the continuous mixing method in the third embodiment, in the introduction period from the time when mixing has been initiated with the mixing cylinder 3 empty until the time when the mixing cylinder 3 is filled with the mixed material, the shaft member 2 is rotated at the introduction rotation speed $R_a$ of 150 to 400 rpm, and after the mixing cylinder 3 is filled with the mixed material, the rotation speed is modified to a mixing rotation speed $R_b$. That is, the continuous mixing method in the third embodiment is similar to the continuous mixing method explained in the first embodiment, except that the rotation speed during mixing initiation is the introduction rotation speed $R_a$ of 150 to 400 rpm instead of the mixing rotation speed $R_b$ of 600 to 1800 rpm, and the rotation speed is changed to the mixing rotation speed $R_b$ after the mixed material fills the mixing cylinder 3.

Of course, this third embodiment exhibits effects similar to those of the first embodiment described above.

In the third embodiment, furthermore, in a state in which the mixed material comprising the powder/granular material and the viscous liquid has not filled the mixing cylinder 3 and uniform mixing cannot be easily achieved, the shaft member 2 is rotated at the rotation speed $R_a$ which is lower than the mixing rotation speed $R_b$, thereby retaining the mixed material comprising the powder/granular material and the viscous liquid inside the mixing cylinder 3 for a long time. This makes it possible to sufficiently and uniformly carry out mixing even in a state in which uniform mixing is not easily achieved.

Additionally, it is possible to automate the control of and easily use the continuous mixing system 130 because the determination of whether or not the mixed material comprising the powder/granular material and the viscous liquid has filled the mixing cylinder 3 is made by the determination device 11B, and the results thereof are used by the control device 9 to change the rotation speed.

First Modified Example of Third Embodiment

Next, a first modified example of the continuous mixing system 130 shown as the third embodiment described above will be explained using FIG. 13. FIG. 13 is an explanatory diagram showing the relationship between the time from mixing initiation and the rotation speed of the shaft member in the first modified example of the third embodiment described above. The continuous mixing system in the modified example differs from the continuous mixing system 130 described above in that the change of the rotation speed from the introduction rotation speed $R_a$ to the mixing rotation speed $R_b$ is performed stepwise 20, or continuously 21, that is, the rotation speed is gradually changed over time.

Of course, the modified example exhibits effects similar to those of the first and third embodiments described above.

In the modified example, furthermore, it becomes possible to reduce the load on the driving device 6 since the rotation speed is stepwise or gradually changed.

Second Modified Example of Third Embodiment

Next, a second modified example of the continuous mixing system 130 shown as the third embodiment described above will be explained using FIG. 14. FIG. 14 is an explanatory diagram showing the relationship between the time and the rotation speed of the shaft member, from a supply termination time $T_c$ of the powder/granular material and the viscous liquid until a discharge completion time $T_d$ of mixed material. The continuous mixing system in the modified example differs from the continuous mixing system 130 described above in that the period for rotating the shaft member 2 at a rotation speed which is lower than the mixing rotation speed $R_b$ is not the period from the initiation of the loading of the powder/granular material and the injecting of the viscous liquid to the mixing cylinder 3 until the mixed material comprising the powder/granular material and the viscous liquid begins to be discharged from the mixed material discharge port 5, but the period from when the supply of the powder/granular material and the viscous liquid is stopped until all of the mixed material comprising the powder/granular material and the viscous liquid retained in the mixing cylinder 3 is discharged from the mixed material discharge port 5.

In the period from when the supply of the powder/granular material and the viscous liquid is stopped in a state in which the mixing cylinder 3 is filled with the mixed material comprising the powder/granular material and the viscous liquid until all of the mixed material comprising the powder/granular material and the viscous liquid retained in the mixing cylinder 3 has been discharged from the mixed material discharge port 5, similar to the third embodiment, the mixed material comprising the powder/granular material and the viscous liquid has not filled the mixing cylinder 3, so it is preferable to improve the mixing efficiency. As such, in the termination period after the supply of the powder/granular material is stopped in a state in which mixed material has filled the mixing cylinder 3 and the determination device 11B determines that mixed material does not fill the mixing cylinder, the control device 9 changes the rotation speed of the shaft member 2 from the mixing rotation speed $R_b$ to a termination rotation speed $R_c$ of 150 to 400 rpm. This allows for extending the time during which the mixed material comprising the powder/granular material and the viscous liquid is retained in the mixing cylinder 3, so the mixing efficiency improves.

In the continuous mixing method in the modified example, in the termination period after the supply of the powder/granular material is stopped in a state in which mixed material has filled the mixing cylinder 3, the rotation speed of the shaft member 2 is changed from the mixing rotation speed $R_b$ to the termination rotation speed $R_c$ of 150 to 400 rpm. That is, the continuous mixing method in the modified example is similar to the continuous mixing method explained in the first embodiment, except that the rotation speed is changed to the termination rotation speed $R_c$ during the period from when the supply of the powder/granular material and the viscous liquid is stopped until all of the mixed material comprising the powder/granular material and the viscous liquid retained in the mixing cylinder 3 is discharged from the mixed material discharge port 5.

Of course, the modified example exhibits effects similar to those of the first and third embodiments described above.

Third Modified Example of Third Embodiment

Next, a third modified example of the third embodiment described above will be explained using FIG. 15. The modified third example is a further modified example of the continuous mixing system shown as the second modified example of the third embodiment. FIG. 15 is an explanatory diagram showing the relationship between the mixing time and the rotation speed of the shaft member in the third modified example of the third embodiment. The continuous mixing system in the modified example differs from the continuous mixing system of the second modified example of the third embodiment in that the change of the rotation speed from the mixing rotation speed $R_b$ to the termination rotation speed $R_c$ is performed stepwise 22, or continuously 23.

Of course, the modified example exhibits effects similar to those of the first and third embodiments described above.

In the modified example, furthermore, it becomes possible to reduce the load on the driving device 6 since the rotation speed is stepwise and gradually changed.

Fourth Modified Example of Third Embodiment

Next, a fourth modified example of the continuous mixing system 130 shown as the third embodiment described above will be explained using FIG. 16. FIG. 16 is a schematic block diagram of the continuous mixing system 134 shown as the fourth modified example of the third embodiment described above. The continuous mixing system 134 in the modified example differs from the continuous mixing system 130 described above in that the determination device 11A is a timer that is set to the time until mixed material of the powder/granular material and the viscous liquid is discharged, which is measured beforehand.

When the set time arrives, the determination device 11A transmits a signal indicating this to the control device 9. Upon receiving the signal from the determination device 11A, the control device 9 sends an instruction to the transmission device 8A to change the rotation speed.

In the configuration described above, control can be accurately performed since the rotation speed can always be switched by the set time.

Of course, the modified example exhibits effects similar to those of the first and third embodiments described above.

Fifth Modified Example of Third Embodiment

Next, a fifth modified example of the continuous mixing system 130 shown as the third embodiment described above will be explained using FIG. 17. FIG. 17 is a schematic block diagram of the continuous mixing system 135 shown as the fifth modified example of the third embodiment described above. The continuous mixing system 135 in the modified example differs from the continuous mixing system 130 described above in that a determination device 11C is a current detector that detects the current of the driving device 6.

The determination device 11C determines whether or not a detected current value is a preset current value, and transmits the determination result to the control device 9. Upon receiving the signal from the determination device 11C, the control device 9 sends an instruction to the transmission device 8A to change the rotation speed.

Of course, the modified example exhibits effects similar to those of the first and third embodiments described above.

Fourth Embodiment

Next, a continuous mixing system 140 shown as a fourth embodiment will be explained using FIG. 18. FIG. 18 is a schematic block diagram of the continuous mixing system 140 shown as the fourth embodiment. As compared with the continuous mixing system 110 explained as the first embodiment using FIG. 1, a storage unit 12 and an input unit 13 have been added to the continuous mixing system 140 in the modified example.

At least one of either the particle size of the powder/granular material, the flow rate of the powder/granular material, the type of the viscous liquid, or addition amount of the viscous liquid, and the desired mass of the mixed material is inputted into the input unit 13. The inputted values are transmitted to the control device 9.

In the storage unit 12, the time needed for mixing a unit of mass of the mixed material and the time needed for the mixed material comprising the powder/granular material and the viscous liquid to begin to be discharged from a state in which the mixing cylinder 3 is empty are stored beforehand. Additionally, the storage unit 12 stores correspondences between a plurality of combinations of the particle size of the powder/granular material, the flow rate of the powder/granular material, the type, i.e. the viscosity, of the viscous liquid, and the addition amount of the viscous liquid, and the suitable rotation speed of the shaft member 2 with respect to each of the plurality of combinations. The values stored in the storage unit 12 are viewable by request from the control device 9.

The control device 9 calculates the required total run-time based on the time required for mixing a unit mass of the mixed material and the mass of the mixed material to be discharged, and controls the transmission device 8A for the duration of the required total run-time. In more detail, the control device 9 obtains the time required for mixing a unit mass of the mixed material and the time required for the mixed material to begin to be discharged, which are stored in the storage unit 12, and calculates the required total run-time of the continuous mixing system 140 from the times thereof and the desired mass of the mixed material received from the input unit 13. The control device 9, furthermore, selects and determines the suitable rotation speed for the powder/granular material and the viscous liquid to be used from the correspondences stored in the storage unit 12 based on the values of the particle size of the powder/granular material, the flow rate of the powder/granular material, the type of the viscous liquid, and the addition amount of the viscous liquid and the like that have been received from the input unit 13. The control device 9 controls the transmission device 8A based on these computed values.

That is, the continuous mixing system 140 is controlled by the control device 9 in such a way that the control device 9 controls the transmission device 8A so as to rotate the shaft member 2 at a determined rotation speed for the duration of the required total run-time calculated by the control device 9, and so as to rotate the shaft member 2 at a suitable rotation speed and automatically stop the rotation after mixing only the desired mass of the mixed material.

Of course, the fourth embodiment exhibits effects similar to those of the first embodiment described above.

In the fourth embodiment, furthermore, since the continuous mixing system is controlled based on the inputted values of at least one of the particle size of the powder/granular material, the flow rate of the powder/granular material, the type of the viscous liquid, and the addition amount of the viscous liquid, and the desired mass of the mixed material, it becomes possible to mix only the necessary quantity of the powder/granular material and the viscous liquid under appropriate conditions, regardless of the kinds thereof.

Fifth Embodiment

Next, a continuous mixing system 150 shown as a fifth embodiment will be explained using FIG. 19. FIG. 19 is a schematic block diagram of the continuous mixing system 150 shown as the fifth embodiment. Compared with the continuous mixing system 140 explained as the fourth embodiment using FIG. 18, a determination device 11A that determines when the mixed material comprising the powder/granular material and the viscous liquid has filled the mixing cylinder 3, similar to that explained in the third embodiment and the modified examples thereof, has been added to the continuous mixing system 150 in the modified example.

The determination device 11A is a timer set to the time until the mixed material comprising the powder/granular material and the viscous liquid is discharged, which is measured beforehand, as described in the fourth modified example of the third embodiment.

The input unit 13 is provided with a similar configuration as the fourth embodiment described above. That is, at least one of either the particle size of the powder/granular material, the flow rate of the powder/granular material, the type of the viscous liquid, or addition amount of the viscous liquid, and the desired mass of the mixed material is inputted into the input unit 13. The inputted values are transmitted to the control device 9.

In the storage unit 12, similar to the fourth embodiment, the time needed for mixing a unit mass of the mixed material and the time needed for the mixed material comprising the powder/granular material and the viscous liquid to begin to be discharged from a state in which the mixing cylinder 3 is empty are stored beforehand. Additionally, the storage unit 12 stores correspondences between a plurality of combinations of the particle size of the powder/granular material, the flow rate of the powder/granular material, and the type, i.e. the viscosity, of the viscous liquid, and the addition amount of the viscous liquid, and the suitable introduction rotation speed and the mixing rotation speed explained in the third embodiment and the modified examples thereof of the shaft member 2 with respect to each of the plurality of combinations. The values stored in the storage unit 12 are viewable by request from the control device 9.

The control device 9, similar to the fourth embodiment, obtains the time required for mixing a unit mass of the mixed material and the time required for the discharging of the mixed material to start, which are stored in the storage unit 12, and calculates the required total run-time of the continuous mixing system 150 from the times thereof and the desired mass of the mixed material received from the input unit 13. Furthermore, the control device 9 selects and determines the suitable introduction rotation speed and mixing rotation speed for the powder/granular material and the viscous liquid to be used from the correspondences stored in the storage unit 12 based on the values of the particle size of the powder/granular material, the flow rate of the powder/granular material, the type of viscous liquid, and the addition amount of the viscous liquid etc. received from the input unit 13. The control device 9 controls the transmission device 8A based on these computed values.

That is, the continuous mixing system 150 is controlled by the control device 9 so that, during the period from when the loading of the powder/granular material and injecting of the viscous liquid to the mixing cylinder 3 is initiated until the determination device 11A determines that the mixed material comprising the powder/granular material and the viscous liquid has begun to be discharged from the mixed material discharge port 5, the control device 9 controls the transmission device 8A so that the shaft member 2 is rotated at a determined introduction rotation speed, and thereafter, for the duration of the required total run-time calculated by the control device 9, at a mixing rotation speed, so that the shaft member 2 is rotated at a suitable rotation speed in accordance with circumstances, and is automatically stopped after mixing only the desired mass of mixed material.

Of course, the fifth embodiment exhibits effects similar to those of the first, third and fourth embodiments described above.

Modified Example of Fifth Embodiment

Next, a modified example of the continuous mixing system 150 shown as the fifth embodiment described above will be explained. The continuous mixing system in the modified example differs from the continuous mixing system 150 described above in that the change of the rotation speed from the introduction rotation speed to the mixing rotation speed is performed stepwise, or continuously, as described in the first modified example of the third embodiment.

In this case, compared to the fifth embodiment described above, when changing the rotation speed stepwise, the rotation speed and rotation time in each step, or when changing the rotation speed continuously, the rotation speed change per unit time may have different suitable values depending on the properties of the powder/granular material and the viscous liquid. Thus, in the modified example, in addition to the values of the time required for mixing a unit mass of the mixed material and the time required for the mixed material comprising the powder/granular material and the viscous liquid to begin to be discharged from a state in which the mixing cylinder 3 is empty and the like which are stored in the continuous mixing system 150, the storage unit 12 also stores correspondences between a plurality of combinations of the particle size of the powder/granular material, the flow rate of the powder/granular material, and the type, i.e. the viscosity, of the viscous liquid, and the addition amount of the viscous liquid, and the suitable introduction rotation speed and mixing rotation speed, rotation speed change time, and rotation speed increase amount and the like of the shaft member 2 with respect to each of the plurality of combinations.

As with the continuous mixing system 150, the correspondences are used for selecting and determining the suitable rotation speed change time and rotation speed increase amount and the like for the powder/granular material and the viscous liquid to be used, based on the values of the particle size of the powder/granular material, the flow rate of the powder/granular material, the type of viscous liquid, and the addition amount of the viscous liquid and the like.

Of course, the modified example exhibits effects similar to those of the first, third and fifth embodiments described above.

In the modified example, furthermore, it becomes possible to reduce the load on the driving device 6 since the rotation speed is stepwise and gradually changed.

Sixth Embodiment

Next, a continuous mixing system 160 shown as a sixth embodiment will be explained using FIG. 20. FIG. 20 is a schematic block diagram of the continuous mixing system 160 shown as the sixth embodiment. As compared with the continuous mixing system 140 explained as the fourth embodiment using FIG. 18, a forward-reverse rotation device 10A, similar to that explained in the second embodiment and the modified examples thereof, and a determination device 11A that determines when mixed material of the powder/granular material and the viscous liquid has filled the mixing cylinder 3, similar to that explained in the third embodiment and the modified examples thereof, has been added to the continuous mixing system 160 in the modified example.

In the storage unit 12, similar to the fourth embodiment, the time needed for mixing a unit mass of the mixed material and the time needed for the mixed material comprising the powder/granular material and the viscous liquid to begin to be discharged from a state in which the mixing cylinder 3 is empty are stored beforehand. The storage unit 12 also stores the correspondences between a plurality of combinations of the particle size of the powder/granular material, the flow rate of the powder/granular material, and the type, i.e. the viscosity, of the viscous liquid, and the addition amount of the viscous liquid, and the suitable rotation speed, number of reverse-rotations, and reverse-rotation time for each reverse rotation of the shaft member 2 with respect to each of the plurality of combinations. The number of reverse-rotations and reverse-rotation time for each reverse rotation are provided with values similar to those explained in the second embodiment and modified examples thereof. The values stored in the storage unit 12 are viewable by request from the control device 9.

The control device 9, similar to the fourth embodiment, obtains the time required for mixing a unit mass of the mixed material and the time required for the discharging of the mixed material to start, which are stored in the storage unit 12, and calculates the required total run-time of the continuous mixing system 160 from the times thereof and the desired mass of the mixed material received from the input unit 13. Furthermore, the control device 9 selects and determines the suitable rotation speed, number of reverse-rotations, and reverse-rotation time for each reverse rotation of the shaft member 2 for the powder/granular material and the viscous liquid to be used, from the correspondences stored in the storage unit 12, based on the values of the particle size of the powder/granular material, the flow rate of the powder/granular material, the type of viscous liquid, and the addition amount of the viscous liquid and the like received from the input unit 13. The control device 9 controls the transmission device 8A based on these computed values.

That is, the continuous mixing system 160 rotates the shaft member 2 at a determined rotation speed for the duration of the required total run-time calculated by the control device 9. The continuous mixing system 160, furthermore, is controlled by the control device 9 so that, during the period from when the loading of the powder/granular material and the injection of the viscous liquid into the mixing cylinder 3 is initiated until the determination device 11A determines that the mixed material comprising the powder/granular material and the viscous liquid has begun to be discharged from the mixed material discharge port 5, and/or, during the period from when the supply of the powder/granular material and the viscous liquid is stopped in a state in which the mixing cylinder 3 has been filled with the mixed material comprising the powder/granular material and the viscous liquid until the determination device 11A determines that all of the mixed material comprising the powder/granular material and the viscous liquid retained in the mixing cylinder 3 has been discharged from the mixed material discharge port 5, the control device 9 controls the transmission device 8A so that the shaft member 2 is reverse-rotated once or multiple times, for an arbitrary period of time in the range of 0.2 seconds to 10 seconds, and so that the shaft member 2 is rotated at a suitable rotation speed in accordance with circumstances, and is automatically stopped after mixing only the desired mass of the mixed material.

Of course, the sixth embodiment exhibits effects similar to those of the first to fourth embodiments described above.

First Modified Example of Sixth Embodiment

Next, a modified example of the continuous mixing system 160 shown as the sixth embodiment described above will be explained. The continuous mixing system in the modified example differs from the continuous mixing system 160 described above in that the rotation speed is changed from the introduction rotation speed to the mixing rotation speed, as described in the fifth embodiment and the like.

In the storage unit 12, similar to the sixth embodiment, the time needed for mixing a unit mass of the mixed material and the time needed for the mixed material comprising the powder/granular material and the viscous liquid to begin to be discharged from a state in which the mixing cylinder 3 is empty are stored beforehand. The storage unit 12 also stores correspondences between a plurality of combinations of the particle size of the powder/granular material, the flow rate of the powder/granular material, and the type, i.e. the viscosity, of the viscous liquid, and the addition amount of the viscous liquid, and the suitable introduction rotation speed and mixing rotation speed, number of reverse-rotations, and the reverse-rotation time for each reverse rotation of the shaft member 2 with respect to each of the plurality of combinations.

The control device 9, similar to the sixth embodiment described above, calculates the required total run-time of the continuous mixing system. Furthermore, the control device 9 selects and determines the suitable introduction rotation speed and mixing rotation speed, number of reverse-rotations, and reverse-rotation time for each reverse rotation of the shaft member 2 for the powder/granular material and the viscous liquid to be used, from the correspondences stored in the storage unit 12, based on the values of the particle size of the powder/granular material, the flow rate of the powder/granular material, the type of viscous liquid, and the addition amount of the viscous liquid and the like received from the input unit 13. The control device 9 controls the transmission device 8A based on these computed values.

That is, the continuous mixing system in the modified example rotates the shaft member 2 at a determined rotation speed for the duration of the required total run-time calculated by the control device 9. In the continuous mixing system, furthermore, the control device 9 controls the transmission device 8A so that, during the period from when the loading of the powder/granular material and the injection of the viscous liquid into the mixing cylinder 3 is initiated until the determination device 11A determines that the mixed material comprising the powder/granular material and the viscous liquid has begun to be discharged from the mixed material discharge port 5, the shaft member 2 is rotated at a determined introduction rotation speed followed by a mixing rotation speed, and further, during the period from when the loading of the powder/granular material and the injection of the viscous liquid into the mixing cylinder 3 is initiated until the determination device 11A determines that the mixed material comprising the powder/granular material and the viscous liquid has begun to be discharged from the mixed material discharge port 5, and/or, during the period from when the supply of the powder/granular material and the viscous liquid is stopped in a state in which the mixing cylinder 3 has been filled with the mixed material comprising the powder/granular material and the viscous liquid until all of the mixed material comprising the powder/granular material and the viscous liquid retained in the mixing cylinder 3 has been discharged from the mixed material discharge port 5, the shaft member 2 is reverse-rotated once or multiple times, for an arbitrary period of time in the range of 0.2 seconds to 10 seconds.

Of course, the modified example exhibits effects similar to those of the first to sixth embodiments described above.

Second Modified Example of Sixth Embodiment

Next, a differing modified example of the continuous mixing system shown as the first modified example of the sixth embodiment described above will be explained. The continuous mixing system in the modified example differs from the continuous mixing system shown as the first modified example of the sixth embodiment described above in that the change of rotation speed from the introduction rotation speed to the mixing rotation speed is performed stepwise, or continuously, as described in the modified example of the fifth embodiment.

In this case, as explained in the modified example of the fifth embodiment, compared to the fifth embodiment described above, when modifying the rotation speed stepwise, the rotation speed and rotation time in each step, or when modifying the rotation speed continuously, the rotation speed change per time, may have differing suitable values depending on the properties of the powder/granular material and the viscous liquid. Thus, in the modified example, in addition to the values of the time required for mixing a unit mass of the mixed material and the time required for the mixed material comprising the powder/granular material and the viscous liquid to begin to be discharged from a state in which the mixing cylinder 3 is empty and the like, the storage unit 12 also stores correspondences between a plurality of combinations of the particle size of the powder/granular material, the flow rate of the powder/granular material, and the type, i.e. the viscosity, of the viscous liquid, and the addition amount of the viscous liquid, and the suitable introduction rotation speed and mixing rotation speed, number of reverse-rotations, time of each reverse-rotation, rotation speed change, and rotation speed increase amount and the like of the shaft member 2 with respect to each of the plurality of combinations.

The correspondences thereof are used for selecting and determining the suitable introduction rotation speed and mixing rotation, number of reverse-rotations, time of each reverse-rotation, rotation speed change time and rotation speed increase amount and the like for the powder/granular material and the viscous liquid to be used, based on the values of the particle size of the powder/granular material, the flow rate of the powder/granular material, the type of viscous liquid, and the addition amount of the viscous liquid and the like.

Of course, the modified example exhibits effects similar to those of the first to sixth embodiments and the like described above.

Other Modified Examples

The continuous mixing apparatus, system, and continuous mixing method for a powder/granular material and a viscous liquid of this invention are not to be construed as being limited to the embodiments and modified examples disclosed above that were explained with reference to drawings, and various other modified examples may be contemplated within the technical scope thereof.

For example, in the embodiments and modified examples described above, the driving device 6 was an AC motor, but it can also be a DC motor. When using a DC motor as the driving device 6, for example in FIG. 1, the transmission device 8A is a voltage converter that changes the voltage of a power supply, not shown, to be supplied to the DC motor that is the driving device 6, or a pulse width modulator that changes the intervals of turning on and off the power supply to the DC motor which is the driving device 6. By using such a transmission device 8A, when the driving device 6 is a DC motor, it becomes possible to easily change the rotation speed of the driving device 6.

Additionally, in the embodiments and modified examples using the electrical transmission device 8A, a mechanical transmission device can alternatively be used. Likewise, in the embodiments and modified examples using the electrical forward-reverse rotation device 10A, a mechanical forward-reverse rotation device inserted between the driving device 6 and the shaft member 2 can alternatively be used. Furthermore, when employing a mechanical type for both the transmission device and the forward-reverse rotation device, a structure integrating the transmission device and the forward-reverse rotation device may be employed.

Additionally, for example in the second embodiment, and in the second modified example of the second embodiment, the forward rotation and reverse-rotation times are equal, and reverse-rotation is performed a plurality of times. However, the operation times of the forward rotations and reverse-rotations and the number of reverse-rotations are not limited thereto. The operation times of the forward rotations and reverse-rotations may all be different times as long as each rotation is an arbitrary length of time in the range of 0.2 seconds to 10 seconds. Additionally, the number of reverse-rotations can be one rotation if the mixed material comprising the powder/granular material and the viscous liquid can be retained so as to sufficiently mix the mixed material with just one reverse rotation.

Additionally, in the embodiments and modified examples described above, when modifying the rotation speed stepwise, as shown in FIG. 13 and FIG. 15, the increase in the rotation speed and the rotation time in each step are constant, and when changing the rotation speed continuously, the rate of change of the rotation speed is constant, but the invention is not so limited. For example, when increasing the rotation speed stepwise, the rotation time at a low rotation speed may be made longer and be made shorter as the rotation speed increases, and/or, when making the rotation speed before the change 150 rpm and the rotation speed after the change 600 rpm, the increase in the rotation speed may be nonuniform, such as 150 rpm→350 rpm→500 rpm→550 rpm→600 rpm. In addition, even when continuously raising the rotation speed, the rate of change does not always have to be constant, and the rate of change may be changed a plurality of times in a broken-line shape, or the rate of change can be changed in a curve instead of linearly.

Thus, the manner in which the rotation speed is changed stepwise or continuously differs depending on the combination of the particle size and the loaded amount of powder/granular material and the viscosity and the injected amount of viscous liquid and the like, so it is preferable to experimentally find the optimum conditions in advance and to set the control device 9 so that the continuous mixing system of the present invention operates under these conditions.

Combinations of Embodiments and Modified Examples Described Above

In addition to the above, it is possible to mix and match the configurations indicated in the embodiments described above and to appropriately modify the configurations to other configurations, without departing from the spirit of this invention.

For example, in the second embodiment, the shaft member 2 is reverse-rotated during the period from when the loading of the powder/granular material and the injection of the viscous liquid into the mixing cylinder 3 are initiated until the mixed material comprising the powder/granular material and the viscous liquid begins to be discharged from the mixed material discharge port 5, and additionally, in the second modified example of the second embodiment, the shaft member 2 is reverse-rotated during the period from when the supply of the powder/granular material and the viscous liquid is stopped until all of the mixed material comprising the powder/granular material and the viscous liquid retained in the mixing cylinder 3 have been discharged from the mixed material discharge port 5, but the second embodiment and the second modified example of the second embodiment may be combined so that the shaft member 2 is reverse-rotated during both of these periods.

Likewise, in the third embodiment and the like, an introduction rotation speed with a lower value than the mixing rotation speed is used during the period from when the loading of the powder/granular material and injecting of the viscous liquid into the mixing cylinder 3 has been initiated until the mixed material comprising the powder/granular material and the viscous liquid begins to be discharged from the mixed material discharge port 5, and in the second modified example of the third embodiment and the like, a termination rotation speed with a lower value than the mixing rotation speed is used during the period from when the supply of the powder/granular material and the viscous liquid is stopped in a state in which the mixing cylinder 3 is filled with the mixed material comprising the powder/granular material and the viscous liquid until all of the mixed material comprising the powder/granular material and the viscous liquid retained in the mixing cylinder 3 has been discharged from the mixed material discharge port 5. Of course, these can be combined and used. That is, it is possible to use an introduction rotation speed with a lower value than the mixing rotation speed during the period from when the loading of the powder/granular material and injecting of the viscous liquid into the mixing cylinder 3 has been initiated until the mixed material comprising the powder/granular material and the viscous liquid begins to be discharged from the mixed material discharge port 5, and also, to use a termination rotation speed with a lower value than the mixing rotation speed during the period from when the supply of the powder/granular material and the viscous liquid is stopped in a state in which the mixing cylinder 3 is filled with the mixed material comprising the powder/granular material and the viscous liquid until all of the mixed material comprising the powder/granular material and the viscous liquid retained in the mixing cylinder 3 has been discharged from the mixed material discharge port 5.

In this case, the termination rotation speed may be equal to the introduction rotation speed, or may differ, depending on the combination of the particle size and the loaded amount of the powder/granular material and the viscosity and injected amount of the viscous liquid and the like.

Likewise, in the fifth embodiment and the modified example, during the period from when the loading of the powder/granular material and injecting of the viscous liquid into the mixing cylinder 3 has been initiated until the determination device 11A determines that the mixed material comprising the powder/granular material and the viscous liquid begins to be discharged from the mixed material discharge port 5, the control device 9 controls the transmission device 8A so that the shaft member 2 is rotated at a determined introduction rotation speed followed by a mixing rotation speed, and rotates the shaft member 2 at a suitable rotation speed in accordance with circumstances. Instead of or in addition to this, as explained in the second modified example of the third embodiment, the control device 9 may be set to control the driving device 6 so that during the period from when the supply of the powder/granular material and the viscous liquid is stopped in a state in which the mixing cylinder 3 is filled with the mixed material comprising the powder/granular material and the viscous liquid until all of the mixed material comprising the powder/granular material and the viscous liquid retained in the mixing cylinder 3 is discharged from the mixed material discharge port 5, the rotation speed is lowered from the suitable mixing rotation speed to the termination rotation speed, and thereafter, and the shaft member is rotated at the termination rotation speed. Of course, the changes of these rotation speeds can be performed stepwise or continuously.

Furthermore, and likewise, in the first and second modified examples of the sixth embodiment, the control device 9 is made to control the transmission device 8A so that, during the period from when the loading of the powder/granular material and the injection of the viscous liquid into the mixing cylinder 3 is initiated until the determination device 11A determines that the mixed material comprising the powder/granular material and the viscous liquid has begun to be discharged from the mixed material discharge port 5, the shaft member 2 is rotated at a determined introduction rotation speed followed by a mixing rotation speed, and further, during the period from when the loading of the powder/granular material and the injection of the viscous liquid into the mixing cylinder 3 is initiated until the determination device 11A determines that the mixed material comprising the powder/granular material and the viscous liquid has begun to be discharged from the mixed material discharge port 5, and/or, during the period from when the supply of the powder/granular material and the viscous liquid is stopped in a state in which the mixing cylinder 3 has been filled with the mixed material comprising the powder/granular material and the viscous liquid until all of the mixed material comprising the powder/granular material and the viscous liquid retained in the mixing cylinder 3 has been discharged from the mixed material discharge port 5, the shaft member 2 is reverse-rotated once or multiple times, for an arbitrary period of time in the range of 0.2 seconds to 10 seconds. Instead of or in addition to this, as explained in the second modified example of the third embodiment, the control device 9 may be set to control the driving device 6 so that the supply of the powder/granular material and the viscous liquid is stopped in a state in which the mixing cylinder 3 is filled with the mixed material comprising the powder/granular material and the viscous liquid, the rotation speed is lowered from the suitable mixing rotation speed to the termination rotation speed until all of the mixed material comprising the powder/granular material and the viscous liquid retained in the mixing cylinder 3 is discharged from the mixed material discharge port 5, and the shaft member is then rotated at the termination rotation speed. Of course, the changes of these rotation speeds can be performed stepwise or continuously.

Also, for example, with respect to the third embodiment and the modified examples of the third embodiment, the continuous mixing systems shown therein may be provided with a structure possessing the forward-reverse rotation device 10 shown in the second embodiment and the modified examples of the second embodiment, and may be controlled by the control device 9 so that, during the period from when the loading of the powder/granular material and the injection of the viscous liquid into the mixing cylinder 3 is initiated until the mixed material comprising the powder/granular material and the viscous liquid begins to be discharged from the mixed material discharge port 5, and/or, during the period from when the supply of the powder/granular material and the viscous liquid is stopped in a state in which the mixing cylinder 3 is filled with the mixed material comprising the powder/granular material and the viscous liquid until all of the mixed material comprising the powder/granular material and the viscous liquid retained in the mixing cylinder 3 has been discharged from the mixed material discharge port 5, the shaft member 2 is reverse-rotated once or multiple times, for an arbitrary period of time in the range of 0.2 seconds to 10 seconds.

Also, for example, in the fifth and sixth embodiments and the modified examples, the determination device 11A is a timer that is set to the time until the mixed material comprising the powder/granular material and the viscous liquid is discharged, which is measured beforehand, but the structure of the determination device is not limited thereto, and for example, may be a detector that senses that the mixed material comprising the powder/granular material and the viscous liquid has been discharged from the mixed material discharge port 5, like that explained in the third embodiment, or a structure in which a current detector for detecting the current of an electric motor which is the driving device 6 is used, and the control device 9 determines whether or not the current value detected by the current detector is a preset current value, like that explained in the fifth modified example of the third embodiment.

EXPLANATION OF REFERENCE SYMBOLS

1 (1A, 1B, 1C, 1D) Mixing paddle
1*a* Plate
1*b* Rectangular part
1*c* Arc part
2 Shaft member
2A, 2C First row
2B, 2D Second row
3 Mixing cylinder
4 Powder/granular material feed port
5 Mixed material discharge port
6 Driving device
7 Viscous liquid injection unit
8 Transmission device
9 Control device
10 Forward-reverse rotation device
11 Determination device
12 Storage unit
13 Input unit
100 Continuous mixing apparatus
101 Spiral
110, 111, 120, 121, 130, 134, 135, 140, 150, 160 Continuous mixing system
R Radius of curvature of arc part
L Length of rectangular part
W Width of rectangular part
S Male screw part

The invention claimed is:

1. A continuous mixing apparatus for a powder/granular material and a viscous liquid, the continuous mixing apparatus comprising:
- a mixing cylinder including:
  - a powder/granular material feed port on a first end portion,
  - a mixed material discharge port on a second end portion, and
  - a viscous liquid injection unit disposed between the powder/granular material feed port and the mixed material discharge port;
- a shaft member disposed on a central axis of the mixing cylinder and configured to rotate inside the mixing cylinder; and
- a plurality of mixing paddles disposed on a surface of the shaft member so as to form a spiral around the central axis, the plurality of mixing paddles being, in at least a portion between the viscous liquid injection unit and the mixed material discharge port, attached so as to alternately provide a first row having an attachment angle of 5° to 60° from a direction of the mixed material discharge port with respect to the central axis, and a second row having an attachment angle of −5° to 5° with respect to the central axis.

2. The continuous mixing apparatus of claim 1, wherein the plurality of mixing paddles, near the powder/granular material feed port, are attached at an attachment angle of 5° to 60° from the direction of the mixed material discharge port with respect to the central axis.

3. The continuous mixing apparatus of claim 1, wherein the plurality of mixing paddles, near the mixed material discharge port, are attached at an attachment angle of 120° to 150° from the direction of the mixed material discharge port, with respect to the central axis.

4. The continuous mixing apparatus of claim 1, wherein:
- a cross-sectional profile of the mixing cylinder is circular;
- the plurality of mixing paddles each include a plate, the plate including a rectangular part positioned on the shaft member side, and an arc part disposed on the side of the rectangular part opposite to the shaft member, the arc part having a tip formed in an arc shape having with a radius of curvature equal to a radius of curvature of the mixing cylinder; and
- the rectangular part is formed so that a ratio of a length in a diameter direction from the central axis of the mixing cylinder to a width in a direction orthogonal to the diameter direction is 1:0.5 to 1:3.

5. A continuous mixing system for a powder/granular material and a viscous liquid, the continuous mixing system comprising:

the continuous mixing apparatus of claim 1;

a driving device connected to the shaft member;

a transmission device configured to change the rotation speed of the driving device; and a control device configured to control the transmission device and rotate the shaft member at a mixing rotation speed of 600 to 1800 rpm.

6. The continuous mixing system of claim 5, further comprising a determination device configured to determine whether a mixed material has filled the mixing cylinder.

7. The continuous mixing system of claim 6, wherein:

the control device is configured to rotate the shaft member at an introduction rotation speed of 150 to 400 rpm during an introduction period from when mixing is initiated with the mixing cylinder in an empty state until the determination device determines that the mixed material has filled the mixing cylinder, and the control device is configured to change the rotation speed of the shaft member to the mixing rotation speed upon the determination device determining that the mixed material has filled the mixing cylinder.

8. The continuous mixing system of claim 6, wherein the control device is configured to change the rotation speed of the shaft member from the mixing rotation speed to a termination rotation speed of 150 to 400 rpm during a termination period after a supply of the powder/granular material is stopped in a state in which the mixed material has filled the mixing cylinder and the determination device has determined that mixed material did not fill the mixing cylinder.

9. The continuous mixing system of claim 7, wherein the rotation speed is changed stepwise or continuously.

10. The continuous mixing system of claim 5, further comprising a forward-reverse rotation device controlled by the control device and configured to modify the rotational direction of the driving device.

11. The continuous mixing system of claim 10, wherein the control device is configured to reverse-rotate the shaft member at least once for a period of 0.2 to 10 seconds during an introduction period from when mixing is initiated with the mixing cylinder in an empty state until mixed material has filled the mixing cylinder.

12. The continuous mixing system of claim 10, wherein in the control device is configured to reverse-rotate the shaft member at least once for a period of 0.2 to 10 seconds during a termination period after a supply of the powder/granular material is stopped in a state in which mixed material has filled the mixing cylinder.

13. The continuous mixing system of claim 5, wherein the control device is configured to:

calculate a required total run-time based on a time required for mixing a unit mass of the mixed material and a mass of the mixed material to be discharged, and control the transmission device for a duration of the required total run-time.

14. A continuous mixing method for a powder/granular material and a viscous liquid using a continuous mixing apparatus, the continuous mixing apparatus including:

a mixing cylinder including:

a powder/granular material feed port on a first end portion, a mixed material discharge port on a second end portion, and a viscous liquid injection unit disposed between the powder/granular material feed port and the mixed material discharge port;

a shaft member disposed on a central axis of the mixing cylinder and configured to rotate inside the mixing cylinder; and a plurality of mixing paddles disposed on a surface of the shaft member so as to form a spiral around the central axis in a rotational direction of the shaft member, the plurality of mixing paddles being, in at least a portion between the viscous liquid injection unit and the mixed material discharge port, attached so as to alternately provide a first row having an attachment angle of 5° to 60° from a direction of the mixed material discharge port with respect to the central axis, and a second row with an attachment angle of −5° to 5° with respect to the central axis, the method comprising:

loading the powder/granular material from the powder/granular material feed port;

injecting the viscous liquid from the viscous liquid injection unit;

while rotating the shaft member to mix the powder/granular material and the viscous liquid to form a mixed material, guiding the mixed material in the direction of the mixed material discharge port; and discharging the mixed material from the mixed material discharge port.

15. The continuous mixing method of claim 14, wherein the shaft member is rotated at a mixing rotation speed of 600 to 1800 rpm.

16. The continuous mixing method of claim 15, further comprising:

rotating the shaft member at an introduction rotation speed of 150 to 400 rpm during an introduction period from when mixing is initiated with the mixing cylinder in an empty state until the mixed material has filled the mixing cylinder; and upon the mixed material filling the mixing cylinder, changing the rotation speed to the mixing rotation speed.

17. The continuous mixing method of claim 15, further comprising, changing the rotation speed of the shaft member from the mixing rotation speed to a termination rotation speed of 150 to 400 rpm during a termination period after a supply of the powder/granular material is stopped in a state in which mixed material has filled the mixing cylinder.

18. The continuous mixing method of claim 16, wherein the rotation speed is changed stepwise or continuously.

19. The continuous mixing method of claim 14, wherein, the shaft member is reverse-rotated at least once, for a period of 0.2 to 1.0 seconds each time during an introduction period from when mixing is initiated with the mixing cylinder in an empty state until mixed material fills the mixing cylinder.

20. The continuous mixing method of claim 14, wherein, the shaft member is reverse-rotated at least once, for a period of 0.2 to 10 seconds each time during a termination period after the supply of the powder/granular material is stopped in a state in which mixed material has filled the mixing cylinder.

* * * * *